US007703557B2

(12) United States Patent
Durairajan et al.

(10) Patent No.: US 7,703,557 B2
(45) Date of Patent: Apr. 27, 2010

(54) FIXED CUTTER BIT WITH BACKUP CUTTER ELEMENTS ON PRIMARY BLADES

(75) Inventors: Bala Durairajan, Houston, TX (US); Carl M. Hoffmaster, Houston, TX (US); Charles H. S. Douglas, III, Flint, TX (US); Dennis Cisneros, Kingwood, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 11/760,933

(22) Filed: Jun. 11, 2007

(65) Prior Publication Data

US 2008/0302575 A1 Dec. 11, 2008

(51) Int. Cl.
*E21B 10/43* (2006.01)

(52) U.S. Cl. ..... 175/426; 175/327

(58) Field of Classification Search ..... 175/426, 175/398, 327

See application file for complete search history.

(56) References Cited

U.S. PATENT DOCUMENTS

| | | | | |
|---|---|---|---|---|
| 3,158,216 | A | 11/1964 | Baron et al. | |
| 3,344,870 | A | 10/1967 | Morris | |
| 4,140,189 | A | 2/1979 | Garner | |
| 4,167,980 | A | 9/1979 | Saxman | |
| 4,351,401 | A | 9/1982 | Fielder | |
| 4,444,281 | A | 4/1984 | Schumacher, Jr. et al. | |
| 4,471,845 | A | 9/1984 | Jurgens | |
| 4,591,008 | A | 5/1986 | Oliver | |
| 4,602,691 | A | 7/1986 | Weaver | |
| 4,932,484 | A | 6/1990 | Warren et al. | |
| 4,936,398 | A | 6/1990 | Auty et al. | |
| 4,991,670 | A * | 2/1991 | Fuller et al. | 175/428 |
| 5,010,783 | A | 4/1991 | Sparks et al. | |

(Continued)

FOREIGN PATENT DOCUMENTS

| | | |
|---|---|---|
| EP | 1096103 | 5/2001 |

(Continued)

OTHER PUBLICATIONS

Combined Search and Examination Report for Appl. No. GB0810112.3 dated Jul. 30, 2008 (7 p.).

(Continued)

*Primary Examiner*—David J Bagnell
*Assistant Examiner*—Cathleen R Hutchins
(74) *Attorney, Agent, or Firm*—Conley Rose, P.C.

(57) ABSTRACT

A drill bit for drilling a borehole comprises a bit body having a bit face. In addition, the drill bit comprises a plurality of primary blades. Further, the drill bit comprises a plurality of primary cutter elements mounted to each primary blade and at least one backup cutter element mounted to each primary blade. Still further, the drill bit comprises a plurality of secondary blades. Moreover, the drill bit comprises a plurality of primary cutter elements mounted to each secondary blade. The ratio of the total number of backup cutter elements mounted to the plurality of primary blades to the total number of backup cutter elements mounted to the plurality of secondary blades is greater than 2.0. Each backup cutter element on each primary blade has substantially the same radial position as one of the primary cutter elements on the same primary blade.

49 Claims, 19 Drawing Sheets

U.S. PATENT DOCUMENTS

| | | | | |
|---|---|---|---|---|
| 5,064,007 | A | 11/1991 | Kaalstad | |
| 5,074,367 | A | 12/1991 | Estes | |
| 5,099,929 | A | 3/1992 | Keith et al. | |
| 5,109,935 | A | 5/1992 | Hawke | |
| 5,145,016 | A | 9/1992 | Estes | |
| 5,145,017 | A | 9/1992 | Holster et al. | |
| 5,186,268 | A | 2/1993 | Clegg | |
| 5,222,566 | A | 6/1993 | Taylor et al. | |
| 5,238,075 | A | 8/1993 | Keith et al. | |
| 5,244,039 | A * | 9/1993 | Newton et al. | 175/431 |
| 5,289,889 | A | 3/1994 | Gearhart et al. | |
| 5,407,024 | A | 4/1995 | Watson et al. | |
| 5,456,141 | A | 10/1995 | Ho | |
| 5,494,123 | A | 2/1996 | Nguyen | |
| 5,531,281 | A | 7/1996 | Murdock | |
| 5,549,171 | A | 8/1996 | Mensa-Wilmot et al. | |
| 5,551,522 | A | 9/1996 | Keith et al. | |
| 5,553,581 | A | 9/1996 | Hirabayashi et al. | |
| 5,553,681 | A | 9/1996 | Huffstutler et al. | |
| 5,575,301 | A | 11/1996 | Bolton | |
| 5,582,261 | A | 12/1996 | Keith et al. | |
| 5,592,996 | A | 1/1997 | Keith et al. | |
| 5,607,024 | A | 3/1997 | Keith et al. | |
| 5,607,025 | A | 3/1997 | Mensa-Wilmot et al. | |
| 5,608,162 | A | 3/1997 | Ho | |
| 5,651,421 | A | 7/1997 | Newton et al. | |
| 5,697,462 | A | 12/1997 | Grimes et al. | |
| 5,709,278 | A | 1/1998 | Crawford | |
| 5,746,280 | A | 5/1998 | Scott et al. | |
| 5,755,301 | A | 5/1998 | Love et al. | |
| 5,803,196 | A | 9/1998 | Fielder | |
| 5,816,346 | A * | 10/1998 | Beaton | 175/431 |
| 5,839,526 | A | 11/1998 | Cisneros et al. | |
| 5,862,871 | A | 1/1999 | Curlett | |
| 5,890,550 | A | 4/1999 | Swadi et al. | |
| 5,937,958 | A | 8/1999 | Mensa-Wilmot et al. | |
| 5,979,577 | A | 11/1999 | Fielder | |
| 5,996,713 | A | 12/1999 | Pessier et al. | |
| 6,021,859 | A | 2/2000 | Tibbitts et al. | |
| 6,123,160 | A | 9/2000 | Tibbitts | |
| 6,123,161 | A | 9/2000 | Taylor | |
| 6,164,394 | A | 12/2000 | Mensa-Wilmot et al. | |
| 6,173,797 | B1 | 1/2001 | Dykstra et al. | |
| 6,227,314 | B1 | 5/2001 | Zadrapa et al. | |
| 6,283,233 | B1 | 9/2001 | Lamine et al. | |
| 6,308,790 | B1 | 10/2001 | Mensa-Wilmot et al. | |
| 6,349,780 | B1 | 2/2002 | Beuershausen | |
| 6,408,958 | B1 * | 6/2002 | Isbell et al. | 175/431 |
| 6,427,792 | B1 | 8/2002 | Roberts et al. | |
| 6,481,511 | B2 | 11/2002 | Matthias et al. | |
| 6,536,543 | B2 | 3/2003 | Meiners et al. | |
| 6,575,256 | B1 | 6/2003 | Doster | |
| 6,615,934 | B2 | 9/2003 | Mensa-Wilmot | |
| 6,659,199 | B2 | 12/2003 | Swadi | |
| 6,688,410 | B1 | 2/2004 | Singh et al. | |
| 6,711,969 | B2 | 3/2004 | Meiners et al. | |
| 6,834,733 | B1 | 12/2004 | Maouche et al. | |
| 6,883,623 | B2 * | 4/2005 | McCormick et al. | 175/408 |
| 7,025,156 | B1 | 4/2006 | Caraway | |
| 7,278,499 | B2 | 10/2007 | Richert et al. | |
| 2002/0020565 | A1 * | 2/2002 | Hart et al. | 175/385 |
| 2002/0121393 | A1 | 9/2002 | Thigpen et al. | |
| 2006/0162968 | A1 | 7/2006 | Durairajan et al. | |
| 2006/0185901 | A1 | 8/2006 | Sinor et al. | |
| 2006/0260845 | A1 | 11/2006 | Johnson | |
| 2007/0079995 | A1 * | 4/2007 | McClain et al. | 175/426 |
| 2007/0093996 | A1 | 4/2007 | Cariveau et al. | |
| 2007/0240905 | A1 | 10/2007 | Mensa-Wilmot | |
| 2007/0261890 | A1 * | 11/2007 | Cisneros | 175/331 |
| 2007/0272445 | A1 | 11/2007 | Cariveau et al. | |
| 2008/0135297 | A1 * | 6/2008 | Gavia | 175/57 |

FOREIGN PATENT DOCUMENTS

| | | |
|---|---|---|
| GB | 2294712 | 5/1996 |
| GB | 2301852 | 12/1996 |
| GB | 2309242 | 7/1997 |
| GB | 2317195 | 3/1998 |
| GB | 2329203 | 3/1999 |
| GB | 2349661 | 11/2000 |
| GB | 2357534 | 6/2001 |
| GB | 2378718 | 2/2003 |
| GB | 2393982 | 4/2004 |
| GB | 2417967 | 3/2006 |
| GB | 2438053 | 11/2007 |
| GB | 2450222 | 12/2008 |
| WO | 2007098159 | 8/2007 |
| WO | 2008073309 | 6/2008 |

OTHER PUBLICATIONS

Search Report for Appl. No. GB0708446.0 dated Aug. 8, 2007 (2 p.).
Baker Hughes Christenson; Quantec Performance Update; 2008 (pp. 10).
Baker Hughes Christenson; Quantec Bit; (pp. 1).
Baker Hughes Christensen; Quantec; Premium PDC drill bits; (pp. 1).
Baker Hughes Christensen; Quantec Brochure, 2008; (pp. 8).
Halliburton; Drilling, Evaluation and Gidital Solutions; Security DBS DrillBits; 2007; (pp. 2).
Office Action Dated Jan. 24, 2008 for U.S. Appl. No. 11/382,510; (20 p.).
Response to Office action Dated Jan. 24, 2008 for U.S. Appl. No. 11/382,510; (18 p.).
Final Office Action Dated Aug. 25, 2008 for U.S. Appl. No. 11/382,510; (9 p.).
Response to Final Office Action Dated Aug. 25, 2008 for U.S. Appl. No. 11/382,510; (15 p.).
Office Action Dated Feb. 10, 2009 for U.S. Appl. No. 11/382,510; (12 p.).
Office Action Dated Oct. 30, 2008 for U.S. Appl. No. 11/866,333; (13 p.).
Response to Office Action Dated Oct. 30, 2008 for U.S. Appl. No. 11/866,333; (22 p.).
Notice of Allowance and Fee(s) Due for U.S. Appl. No. 11/866,333; (10 p.).
Canadian Office Action dated Mar. 9, 2009 for U.S. Appl. No. 2,587,287; (3 p.).
Combined Search and Examination Report for Appl. No. GB0708446.0 dated Aug. 9, 2007; (2 p.).
Examination Report for Appl. No. GB0708446.0 dated Nov. 14, 2008; (2 p.).
Combined Search and Examination Report for Appl. No. GB0810112.3 dated Jul. 29, 2008; (4 p.).
Combined Search and Examination Report for Appl. No. GB0822293.7 dated Apr. 17, 2009; (4 p.).
Combined Search and Examination Report for Appl. No. GB0821536.0 dated Feb. 11, 2009; (2 p.).
Combined Search and Examination Report for Appl. No. GB0719244.6 dated Jan. 23, 2008; (3 p.).

* cited by examiner

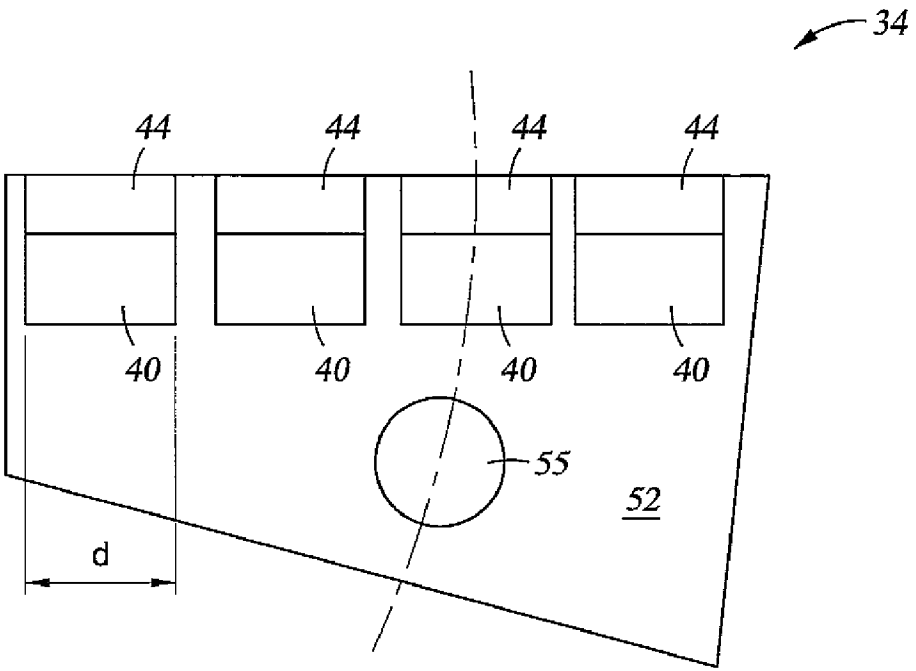
Fig. 9A
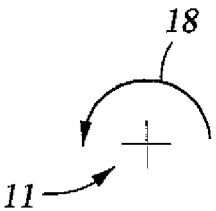

FIXED CUTTER BIT WITH BACKUP CUTTER ELEMENTS ON PRIMARY BLADES

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

1. Field of the Invention

The invention relates generally to earth-boring drill bits used to drill a borehole for the ultimate recovery of oil, gas, or minerals. More particularly, the invention relates to drag bits and to an improved cutting structure for such bits. Still more particularly, the present invention relates to drag bits with backup cutters on primary blades.

2. Background of the Invention

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole thus created will have a diameter generally equal to the diameter or "gage" of the drill bit.

Many different types of drill bits and cutting structures for bits have been developed and found useful in drilling such boreholes. Two predominate types of rock bits are roller cone bits and fixed cutter (or rotary drag) bits. Some fixed cutter bit designs include primary blades, secondary blades, and sometimes even tertiary blades, spaced about the bit face, where the primary blades are generally longer and start at locations closer to the bit's rotating axis. The blades project radially outward from the bit body and form flow channels there between. In addition, cutter elements are often grouped and mounted on several blades. The configuration or layout of the cutter elements on the blades may vary widely, depending on a number of factors. One of these factors is the formation itself, as different cutter layouts cut the various strata with differing results and effectiveness.

The cutter elements disposed on the several blades of a fixed cutter bit are typically formed of extremely hard materials and include a layer of polycrystalline diamond ("PD") material. In the typical fixed cutter bit, each cutter element or assembly comprises an elongate and generally cylindrical support member which is received and secured in a pocket formed in the surface of one of the several blades. A cutter element typically has a hard cutting layer of polycrystalline diamond or other superabrasive material such as cubic boron nitride, thermally stable diamond, polycrystalline cubic boron nitride, or ultrahard tungsten carbide (meaning a tungsten carbide material having a wear-resistance that is greater than the wear-resistance of the material forming the substrate) as well as mixtures or combinations of these materials. The cutting layer is exposed on one end of its support member, which is typically formed of tungsten carbide. For convenience, as used herein, reference to "PD bit" or "PD cutting element" refers to a fixed cutter bit or cutting element employing a hard cutting layer of polycrystalline diamond or other superabrasive material such as cubic boron nitride, thermally stable diamond, polycrystalline cubic boron nitride, or ultrahard tungsten carbide.

While the bit is rotated, drilling fluid is pumped through the drill string and directed out of the drill bit. The fixed cutter bit typically includes nozzles or fixed ports spaced about the bit face that serve to inject drilling fluid into the flow passageways between the several blades. The flowing fluid performs several important functions. The fluid removes formation cuttings from the bit's cutting structure. Otherwise, accumulation of formation materials on the cutting structure may reduce or prevent the penetration of the cutting structure into the formation. In addition, the fluid removes cut formation materials from the bottom of the hole. Failure to remove formation materials from the bottom of the hole may result in subsequent passes by cutting structure to re-cut the same materials, thus reducing cutting rate and potentially increasing wear on the cutting surfaces. The drilling fluid and cuttings removed from the bit face and from the bottom of the hole are forced from the bottom of the borehole to the surface through the annulus that exists between the drill string and the borehole sidewall. Further, the fluid removes heat, caused by contact with the formation, from the cutting elements in order to prolong cutting element life. Thus, the number and placement of drilling fluid nozzles, and the resulting flow of drilling fluid, may significantly impact the performance of the drill bit.

Without regard to the type of bit, the cost of drilling a borehole for recovery of hydrocarbons may be very high, and is proportional to the length of time it takes to drill to the desired depth and location. The time required to drill the well, in turn, is greatly affected by the number of times the drill bit must be changed before reaching the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Accordingly, it is always desirable to employ drill bits which will drill faster and longer, and which are usable over a wider range of formation hardness.

The length of time that a drill bit may be employed before it must be changed depends upon a variety of factors. These factors include the bit's rate of penetration ("ROP"), as well as its durability or ability to maintain a high or acceptable ROP.

Some conventional fixed cutter bits employ three, four, or more relatively long primary blades that may extend to locations proximal the bit's rotating axis (e.g., into the cone region of the bit). For some fixed cutter bits, the presence of a greater number of primary blades may result in a lower ROP. In addition, the greater the number of relatively long primary blades extending along the bit face, the less space is available for the placement of drilling fluid nozzles. Space limitations may result in the placement of fluid nozzles in less desirable locations about the bit. Compromised nozzle placement may also detrimentally impact fluid hydraulic performance, bit ROP, and bit durability. Still further, space limitations for fluid nozzles may result in more complex bit designs necessary to accommodate drilling fluid channels and nozzles. The increased complexity in the design and manufacture of the bit may increase bit costs. Thus, it may be desirable to decrease the number of relatively long primary blades on a drag bit.

The primary blades previously described typically support a plurality of cutter elements that actively engage and remove formation material. A reduction in the total number of cutter elements may detrimentally lower the ROP of the bit. Thus, any reduction in the number of primary blades is preferably accomplished without reducing the total number of cutter elements available to engage and cut the formation.

Accordingly, there remains a need in the art for a fixed cutter bit and cutting structure capable of enhanced ROP and greater bit life, while minimizing other detrimental effects. Such a fixed cutter bit would be particularly well received if it provided a bit with a reduced number of relatively long primary blades, while maintaining a sufficient total cutter count.

BRIEF SUMMARY OF SOME OF THE PREFERRED EMBODIMENTS

In accordance with at least one embodiment of the invention, a drill bit for drilling a borehole in earthen formations comprises a bit body having a bit face including a cone region, a shoulder region, and a gage region. In addition, the drill bit comprises a primary blade extending radially along the bit face from the cone region through the shoulder region to the gage region. Further, the drill bit comprises a plurality of primary cutter elements mounted to the primary blade. Still further, the drill bit comprises at least one backup cutter element mounted to the primary blade in the shoulder region. Moreover, the drill bit comprises a secondary blade extending along the bit face from the shoulder region to the gage region. In addition, the drill bit comprises a plurality of primary cutter elements mounted to the secondary blade. The secondary blade is free of backup cutter elements. Each backup cutter element mounted to the primary blade is disposed at substantially the same radial position as one of the plurality of primary cutter elements mounted to the primary blade.

In accordance with other embodiments of the invention, a drill bit for drilling a borehole in earthen formations comprises a bit body having a bit axis and a bit face comprising a cone region, a shoulder region, and a gage region. In addition, the drill bit comprises a plurality of primary blades, each primary blade extending along the cone region, the shoulder region, and the gage region of the bit face. Further, the drill bit comprises a plurality of primary cutter elements mounted to each primary blade. Still further, the drill bit comprises at least one backup cutter element mounted to each primary blade in the shoulder region. Moreover, the drill bit comprises a plurality of secondary blades, each secondary blade extending along the shoulder region and the gage region of the bit face. In addition, the drill bit comprises a plurality of primary cutter elements mounted to each secondary blade. The ratio of the total number of backup cutter elements mounted to the plurality of primary blades to the total number of backup cutter elements mounted to the plurality of secondary blades is greater than 2.0. Each backup cutter element on each primary blade has substantially the same radial position as one of the primary cutter elements on the same primary blade.

In accordance with another embodiment of the invention, a drill bit for drilling a borehole in earthen formations comprises a bit body having a bit axis and a bit face comprising a cone region, a shoulder region, and a gage region. In addition, the drill bit comprises a first and a second primary blade, each primary blade extending along the cone region, the shoulder region, and the gage region of the bit face. Further, the drill bit comprises a plurality of primary cutter elements mounted to each primary blade. Still further, the drill bit comprises at least one backup cutter element mounted to each primary blade in the shoulder region. Moreover, the drill bit comprises a secondary blade extending along the shoulder region and the gage region of the bit face. In addition, the drill bit comprises a plurality of primary cutter elements mounted to each secondary blade. The ratio of the total number of backup cutter elements mounted to the plurality of primary blades to the total number of backup cutter elements mounted to the plurality of secondary blades is greater than 2.0. The backup cutter element on the first primary blade has a different radial position than each primary cutter element on the first primary blade. The backup cutter element on the first primary blade has the same radial position as one of the primary cutter elements on the second primary blade or one of the primary cutter elements on the secondary blade.

Thus, embodiments described herein comprise a combination of features and advantages intended to address various shortcomings associated with certain prior devices. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a more detailed description of the preferred embodiments, reference will now be made to the accompanying drawings, wherein:

FIG. 9A is a schematic top view of one of the secondary blades shown in FIG. 1.

DETAILED DESCRIPTION OF THE PREFERRED EMBODIMENTS

Figure 1:
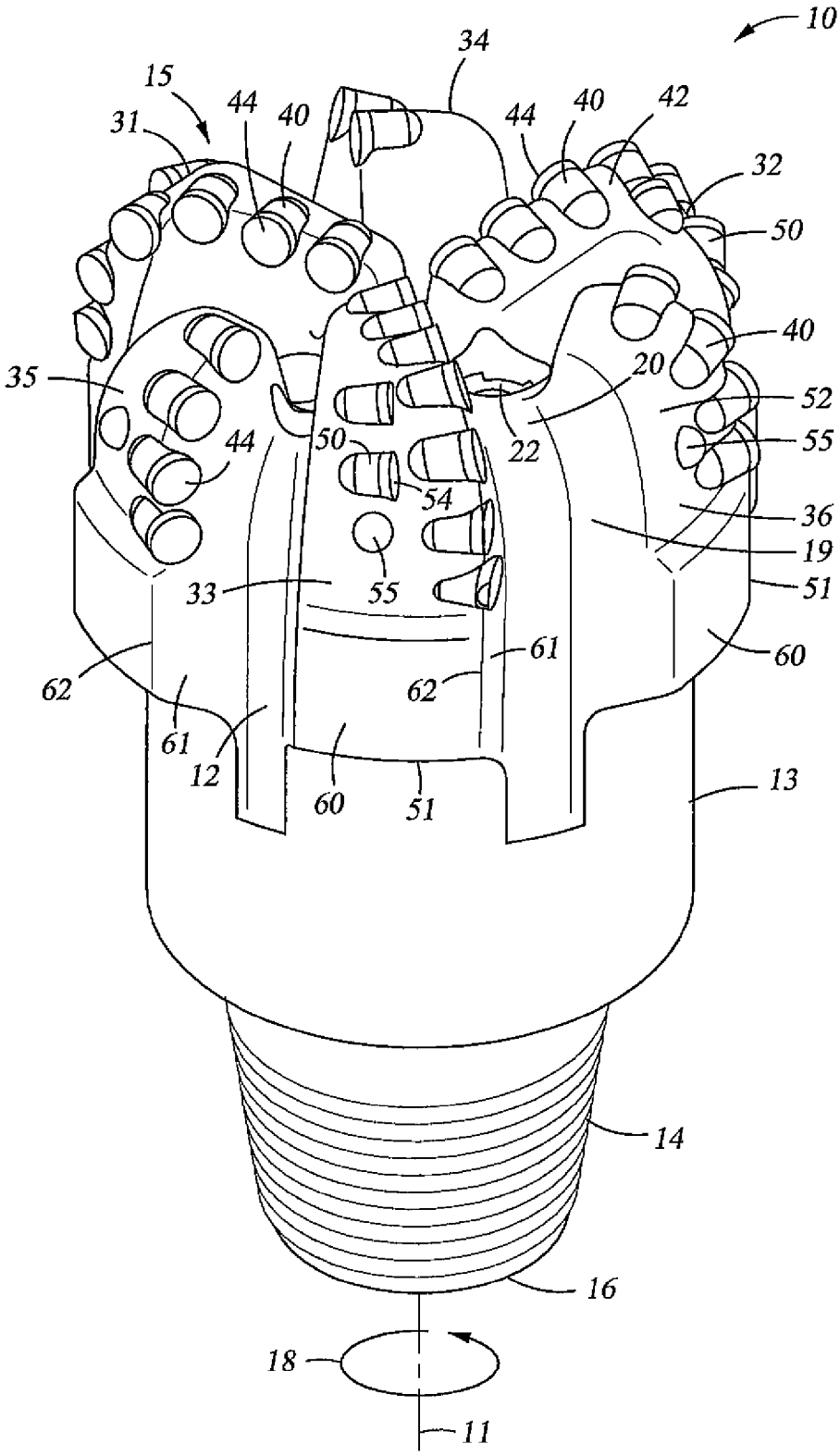
FIG. 1 is a perspective view of an embodiment of a bit made in accordance with the principles described herein.

The following discussion is directed to various embodiments of the invention. The embodiments disclosed have broad application, and the discussion of any embodiment is meant only to be exemplary of that embodiment, and not intended to intimate that the scope of the disclosure, including the claims, is limited to that embodiment or to the features of that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices and connections.

Figure 2:
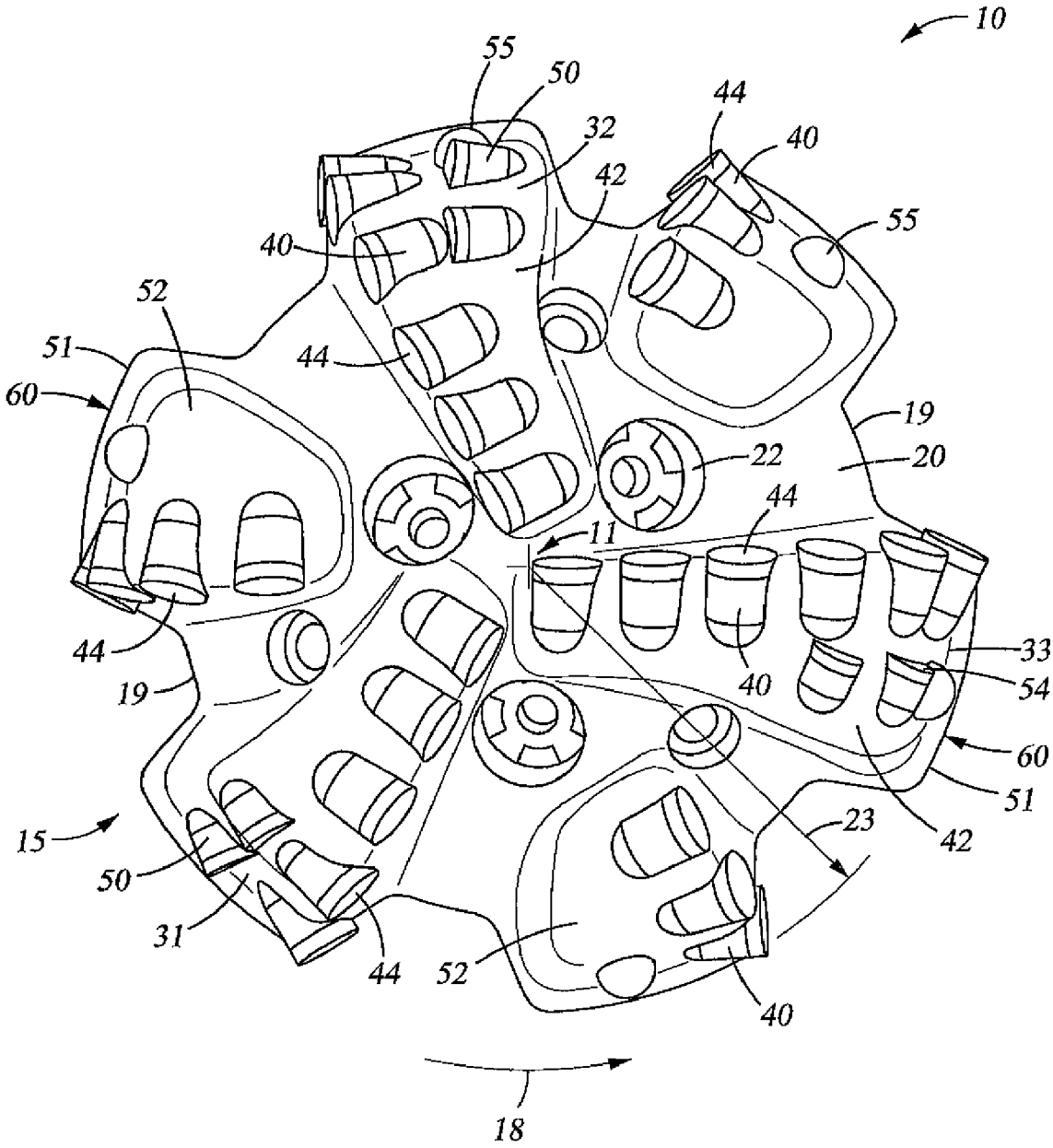
FIG. 2 is a top view of the bit shown in FIG. 1.

Referring to FIGS. 1 and 2, exemplary bit 10 is a fixed cutter bit, sometimes referred to as a drag bit, and is preferably a PD bit adapted for drilling through formations of rock to form a borehole. Bit 10 generally includes a bit body 12, a shank 13 and a threaded connection or pin 14 for connecting bit 10 to a drill string (not shown), which is employed to rotate the bit in order to drill the borehole. Bit face 20 supports a cutting structure 15 and is formed on the end of the bit 10 that is opposite pin end 16. Bit 10 further includes a central axis 11 about which bit 10 rotates in the cutting direction represented by arrow 18. Body 12 may be formed in a conventional manner using powdered metal tungsten carbide particles in a binder material to form a hard metal cast matrix. Alternatively, the body can be machined from a metal block, such as steel, rather than being formed from a matrix.

Figure 3:
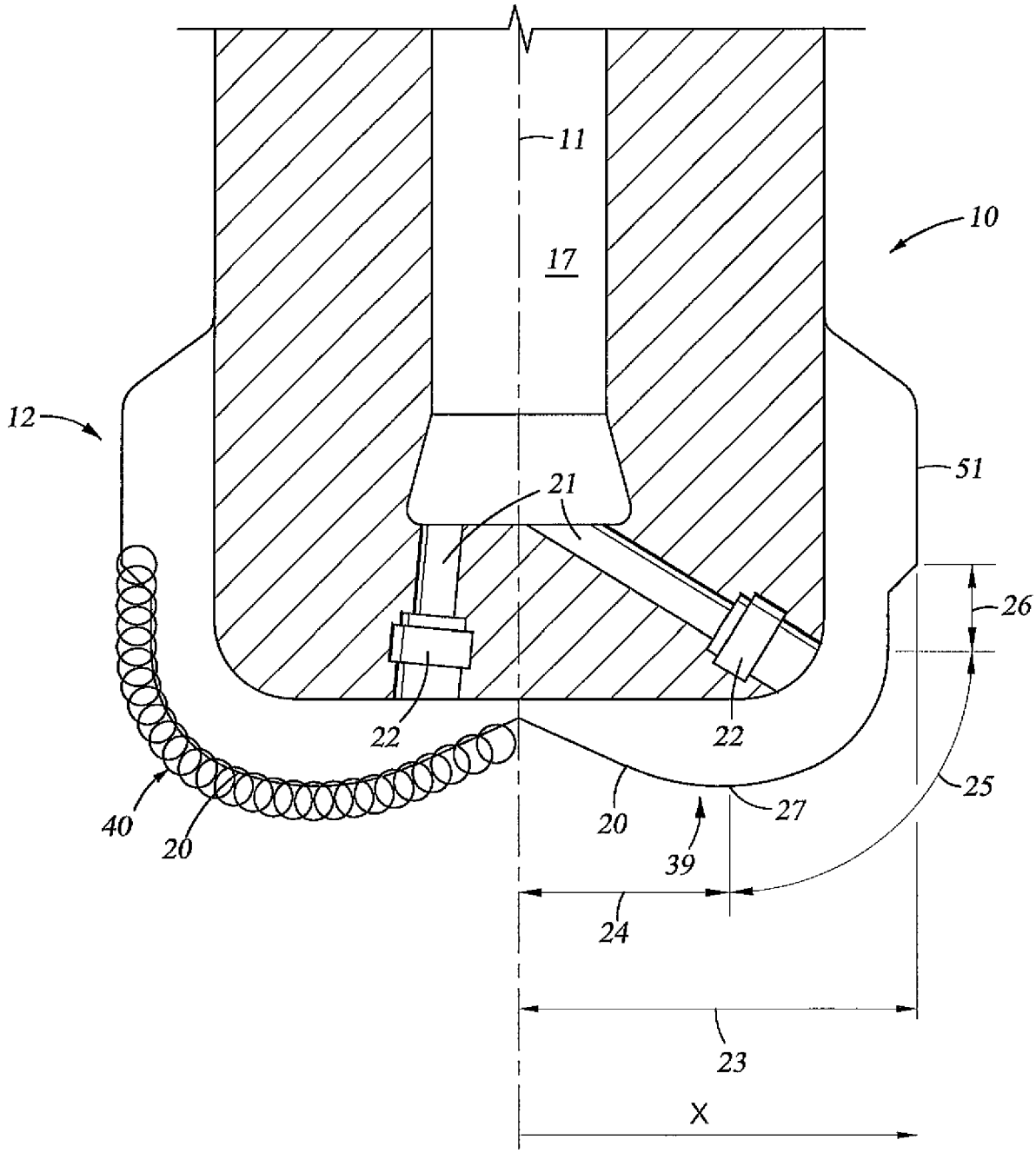
FIG. 3 is a partial cross-sectional view of the bit shown in FIG. 1 with the cutter elements of the bit shown rotated into a single profile.

As best seen in FIG. 3, body 12 includes a central longitudinal bore 17 permitting drilling fluid to flow from the drill string into bit 10. Body 12 is also provided with downwardly extending flow passages 21 having ports or nozzles 22 disposed at their lowermost ends. The flow passages 21 are in fluid communication with central bore 17. Together, passages 21 and nozzles 22 serve to distribute drilling fluids around a cutting structure 15 to flush away formation cuttings during drilling and to remove heat from bit 10.

Referring again to FIGS. 1 and 2, cutting structure 15 is provided on face 20 of bit 10. Cutting structure 15 includes a plurality of blades which extend from bit face 20. In the embodiment illustrated in FIGS. 1 and 2, cutting structure 15 includes three angularly spaced-apart primary blades 31, 32, 33, and three angularly spaced apart secondary blades 34, 35, 36. In particular, in this embodiment, the plurality of blades (e.g., primary blades 31, 32, 33 and secondary blades 34, 35, 36) are uniformly angularly spaced on bit face 20 about bit axis 11. In particular, the three primary blades 31, 32, 33 are uniformly angularly spaced about 120° apart, and the three secondary blades 34, 35, 36 are uniformly angularly spaced about 120° apart. In other embodiments (not specifically illustrated), one or more of the blades may be spaced non-uniformly about bit face 20. Still further, primary blades 31, 32, 33 and secondary blades 34, 35, 36 are circumferentially arranged in an alternating fashion. In other words, one secondary blade 34, 35, 36 is disposed between each pair of primary blades 31, 32, 33. Although bit 10 is shown as having three primary blades 31, 32, 33 and three secondary blades 34, 35, 36, in general, bit 10 may comprise any suitable number of primary and secondary blades. As one example only, bit 10 may comprise two primary blades and four secondary blades.

In this embodiment, primary blades 31, 32, 33 and secondary blades 34, 35, 36 are integrally formed as part of, and extend from, bit body 12 and bit face 20. Primary blades 31, 32, 33 and secondary blades 34, 35, 36 extend generally radially along bit face 20 and then axially along a portion of the periphery of bit 10. In particular, primary blades 31, 32, 33 extend radially from proximal central axis 11 toward the periphery of bit 10. Thus, as used herein, the term "primary blade" may be used to refer to a blade that extends generally radially along the bit face from proximal the bit axis. However, secondary blades 34, 35, 36 are not positioned proximal bit axis 11, but rather, extend radially along bit face 20 from a location that is distal bit axis 11 toward the periphery of bit 10. Thus, as used herein, the term "secondary blade" may be used to refer to a blade that extends from a radial location distal the bit axis. Primary blades 31, 32, 33 and secondary blades 34, 35, 36 are separated by drilling fluid flow courses 19. As used herein, the terms "axial" and "axially" generally mean along or parallel to the bit axis (e.g., bit axis 11), while the terms "radial" and "radially" generally mean perpendicular to the bit axis. For instance, an axial distance refers to a distance measured along or parallel to the bit axis, and a radial distance means a distance measured perpendicular to the bit axis.

Referring still to FIGS. 1 and 2, each primary blade 31, 32, 33 includes a cutter-supporting surface 42 for mounting a plurality of cutter elements, and each secondary blade 34, 35, 36 includes a cutter-supporting surface 52 for mounting a plurality of cutter elements. A plurality of primary cutter elements 40, each having a primary cutting face 44, are mounted to each primary blade 31, 32, 33, and mounted to each secondary blade 34, 35, 36. In particular, primary cutter elements 40 are arranged adjacent one another generally in a first or leading row extending radially along each primary blade 31, 32, 33 and along each secondary blade 33-36. In addition, a plurality of backup cutter elements 50, each having a backup cutting face 54, are mounted to each primary blade 31, 32, 33. More specifically, backup cutter elements 50 are positioned adjacent one another generally in a second or trailing row extending radially along each primary blade 31, 32, 33. In this embodiment, no backup cutter elements 50 are provided on any of secondary blades 34, 35, 36.

On each primary blade 31, 32, 33, backup cutter elements 50 are positioned rearward of primary cutter elements 40. As best seen in FIG. 2, when bit 10 rotates about central axis 11 in the cutting direction represented by arrow 18, primary cutter elements 40 lead or precede each backup cutter element 50 provided on the same primary blade 31, 32, 33. Thus, as used herein, the term "backup cutter element" may be used to refer to a cutter element that trails another cutter element disposed on the same blade when the bit (e.g., bit 10) is rotated in the cutting direction. Consequently, as used herein, the term "primary cutter element" may be used to refer to a cutter element that does not trail any other cutter elements on the same blade.

Although primary cutter elements 40 and backup cutter elements 50 are shown as being arranged in rows, primary cutter elements 40 and/or backup cutter elements 50 may be mounted in other suitable arrangements provided each cutter element is either in a leading position (e.g., primary cutter element 40) or trailing position (e.g., backup cutter element 50). Examples of suitable arrangements may include without limitation, rows, arrays or organized patterns, randomly, sinusoidal pattern, or combinations thereof. In other embodiments, additional rows of cutter elements (e.g., a tertiary row) may be provided on one or more primary blade(s), secondary blade(s), or combinations thereof.

In this embodiment, cutter-supporting surfaces 42, 52 also support a plurality of depth-of-cut limiters 55. In particular, one depth-of-cut limiter 55 extends from the cutter-supporting surfaces 42, 52 of each primary blade 32, 33 and each secondary blade 34, 35, 36, respectively. Each depth-of-cut limiter 55 is a cylindrical stud secured in a mating socket in its respective cutter-supporting surface 42, 52. A generally dome-shaped end of each depth-of-cut limiter extends radially from cutter-supporting surface 42, 52. Depth-of-cut limiters 55 are intended to limit the maximum depth-of-cut of cutting faces 44, 54 as they engage the formation. Although only one depth-of-cut limiter 55 is shown on each blade 32-36, in general, any suitable number of depth-of-cut limiters may be provided on one or more blades of bit 10. In some embodiments, no depth-of-cut limiters (e.g., depth of cut limiters 55) are provided. It should be appreciated that depth-of-cut limiters 55 may have any suitable geometry and are not strictly limited to dome-shaped studs.

Referring still to FIGS. 1 and 2, bit 10 further includes gage pads 51 of substantially equal axial length. Gage pads 51 are disposed about the circumference of bit 10 at angularly spaced locations. Specifically, gage pads 51 intersect and extend from each blade 31-36. Gage pads 51 are integrally formed as part of the bit body 12.

Each gage pad 51 includes a generally gage-facing surface 60 and a generally forward-facing surface 61 which intersect in an edge 62, which may be radiused, beveled or otherwise rounded. Gage-facing surface 60 includes at least a portion that extends in a direction generally parallel to bit access 11 and extends to full gage diameter. In some embodiments, other portions of gage-facing surface 60 may be angled, and thus slant away from the borehole sidewall. Also, in select embodiments, forward-facing surface 61 may likewise be angled relative to central axis 11 (both as viewed perpendicular to central axis 11 or as viewed along central axis 11). Surface 61 is termed generally "forward-facing" to distinguish that surface from the gage surface 60, which generally faces the borehole sidewall. Gage-facing surface 60 of gage pads 51 abut the sidewall of the borehole during drilling. The pads can help maintain the size of the borehole by a rubbing action when primary cutter elements 40 wear slightly under gage. The gage pads also help stabilize the bit against vibration. In other embodiments, one or more of the gage pads (e.g., gage pads 51) may include other structural features. For instance, wear-resistant cutter elements or inserts may be embedded in gage pads and protrude from the gage-facing surface or forward-facing surface.

As described above, the embodiment of bit 10 illustrated in FIGS. 1 and 2 include three relatively longer primary blades 31, 32, 33. As compared to some conventional fixed cutter bits that employ four or more relatively long primary blades, bit 10 has fewer primary blades that extend substantially to the center of bit 10. By reducing the number of relatively long primary blades, embodiments of bit 10 described herein offer the potential for increased ROP. Although fewer relatively long primary blades are provided as compared to some conventional fixed cutter bits, the total cutter element count on this embodiment of bit 10 is not detrimentally reduced since the cutter elements theoretically lost by removing one or more primary blades are replaced by adding a second row of backup cutter elements on each remaining primary blades. Namely, as described above, the embodiment of bit 10 illustrated in FIGS. 1 and 2 includes a first row of primary cutter elements 40 and a second row of backup cutter elements 50 on each primary blade 31, 32, 33. Thus, by including backup cutter elements 50 on primary blades 31, 32, 33, embodiments of bit 10 offer the potential for bits with a reduced number of primary blades, without detrimentally reducing the total number of formation engaging cutter elements.

In addition, it should be appreciated that by reducing the number of relatively long primary blades, the space available on bit face 20 for placement of nozzles 20 is increased. This additional space may be used to improve the placement and/or size of the nozzles, thereby offering the potential for improved bit hydraulics. For instance, improved nozzle placement and/or sizing may enhance the ability of the nozzles to distribute drilling fluids, flush away formation cuttings, remove heat from the bit, or combinations thereof.

Referring now to FIG. 3, an exemplary profile of bit 10 is shown as it would appear with all blades (e.g., primary blades 31, 32, 33 and secondary blades 34, 35, 36) and all primary cutter elements 40 rotated into a single rotated profile. For purposes of clarity, the rotated profile of backup cutter elements 50 and depth-of-cut limiters 55 are not shown in this view.

In rotated profile view, the blades of bit 10 form a combined or composite blade profile 39 generally defined by cutter-supporting surfaces 42, 52 of each blade. Composite blade profile 39 and bit face 20 may generally be divided into three regions conventionally labeled cone region 24, shoulder region 25, and gage region 26. Cone region 24 comprises the radially innermost region of bit 10 and composite blade profile 39 extending generally from bit axis 11 to shoulder region 25. In this embodiment, cone region 24 is generally concave. Adjacent cone region 24 is shoulder (or the upturned curve) region 25. In this embodiment, shoulder region 25 is generally convex. The transition between cone region 24 and shoulder region 25 occurs at the axially outermost portion of composite blade profile 39 (lowermost point on bit 10 in FIG. 3), which is typically referred to as the nose or nose region 27. Next to shoulder region 25 is the gage region 26 which extends substantially parallel to bit axis 11 at the outer radial periphery of composite blade profile 39. In this embodiment, gage pads 51 extend from each blade as previously described. As shown in composite blade profile 39, gage pads 51 define the outer radius 23 of bit 10. Outer radius 23 extends to and therefore defines the full gage diameter of bit 10. As used herein, the term "full gage diameter" is used to describe elements or surfaces extending to the full, nominal gage of the bit diameter.

Still referring to FIG. 3, cone region 24 may also be defined by a radial distance measured from, and perpendicular to, bit axis 11. The radial distance defining the bounds of cone region 24 may be expressed as a percentage of outer radius 23. In the embodiment shown in FIG. 3, cone region 24 extends from central axis 11 to about 50% of outer radius 23. In other embodiments, the cone region (e.g., cone region 24) extends from the bit axis (e.g., bit axis 11) to about 30% of the bit's outer radius (e.g., outer radius 23). Cone region 24 may likewise be defined by the location of one or more secondary blades (e.g., secondary blades 34, 35, 36). In other words, the outer radial boundary of cone region 24 may coincide with the radius at which one or more secondary blades begin. It should be appreciated that the actual radius of the cone region of a bit (e.g., cone region 24) measured from the bit's axis (e.g., axis 11), may vary from bit to bit depending on a variety of factors including without limitation, bit geometry, bit type, location of one or more secondary blades, location of backup cutter elements, or combinations thereof. For instance, in some cases bit 10 may have a relatively flat parabolic profile resulting in a cone region 24 that is relatively large (e.g., 50% of outer radius 23). However, in other cases, bit 10 may have a relatively long parabolic profile resulting in a relatively smaller cone region 24 (e.g., 30% of outer radius 23).

Figure 4:
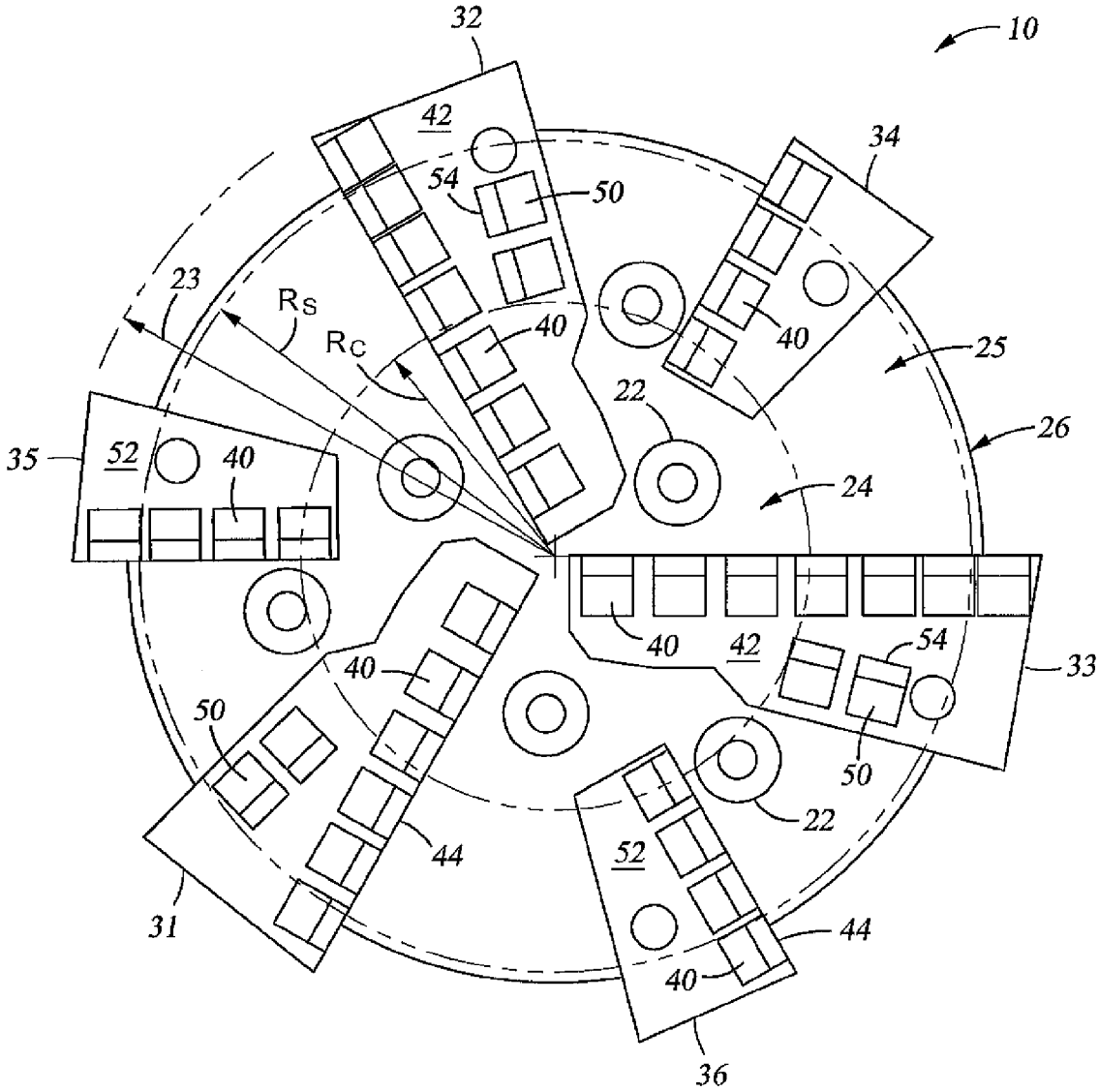
FIG. 4 is a schematic top view of the bit shown in FIG. 1.

Referring now to FIG. 4, a schematic top view of bit 10 is illustrated. Moving radially outward from bit axis 11, bit face 20 includes cone region 24, shoulder region 25, and gage region 26 as previously described. Nose region 27 generally represents the transition between cone region 24 and shoulder region 25. Specifically, cone region 24 extends radially from bit axis 11 to a cone radius $R_c$, shoulder region 25 extends radially from cone radius $R_c$ to shoulder radius $R_s$, and gage region 26 extends radially from shoulder radius $R_s$ to bit outer radius 23.

Primary blades 31, 32, 33 extend radially along bit face 20 from within cone region 24 proximal bit axis 11 toward gage region 26 and outer radius 23. In this embodiment, secondary blades 34, 35, 36 extend radially along bit face 20 from proximal nose region 27 toward gage region 26 and outer radius 23. In other words, secondary blades 34, 35, 36 do not extend significantly into cone region 24. Thus, secondary blades 34, 35, 36 occupy little to no space on bit face 20 within cone region 24.

Although this embodiment shows secondary blades 34, 35, 36 as extending slightly into cone region 24, in other embodiments, one or more secondary blades (e.g., secondary blades 34, 35, 36) may begin at the cone radius (e.g., cone radius $R_c$) and extend toward gage region 26. In such embodiments, the one or more of the secondary blades may be used to define the cone region as described above (i.e., the cone region extends from the bit axis to the start of the secondary blades). In this embodiment, primary blades 31, 32, 33 and secondary blades 34, 35, 36 each extend substantially to gage region 26 and outer radius 23. However, in other embodiments, one or more primary and/or secondary blades may not extend completely to the gage region or outer radius of the bit.

Referring still to FIG. 4, primary blades 31, 32, 33 and secondary blades 34, 35, 36 provide cutter-supporting surfaces 42, 52, respectively, for mounting cutter elements 40, 50 as previously described. In this embodiment, six primary cutter elements 40 arranged in a row are provided on primary blade 31; seven primary cutter elements 40 arranged in a row are provided on primary blade 32; and seven primary cutter elements 40 arranged in a row are provided on primary blade 33. Further, four primary cutter elements 40 arranged in a row are provided on each secondary blade 34, 35, 36. In other embodiments, the number of primary cutter elements (e.g., primary cutter elements 40) on each primary blade (e.g., primary blades 31, 32, 33) and each secondary blade (e.g., secondary blades 34, 35, 36) may differ.

In this embodiment, two backup cutter elements 50 are provided on each primary blade 31, 32, 33. However, secondary blades 34, 35, 36 do not include any backup cutter elements, and thus, may be described as being substantially free of backup cutter elements. However, in other embodiments, one or more backup cutter elements (e.g., backup cutter elements 50) may be provided on one or more secondary blades.

It should be appreciated that due to the additional circumferential space required on a blade (e.g., primary blade, secondary blade, etc.) to mount backup cutter elements (e.g., backup cutter elements 50), a blade with backup cutter elements tends to be wider as compared to a similar blade without backup cutter elements. In other words, backup cutter elements often necessitate the need for a wider blade providing sufficient cutter-supporting surface area to accommodate both primary and backup cutter elements. However, in general, wider blades tend to reduce the space available on the bit face for nozzles. Consequently, secondary blades 34, 35, 36 that include no backup cutter elements 50 offer the potential for enhanced sizing and placement of nozzles on the bit face.

In addition, as compared to secondary blades 34, 35, 36, the positioning of backup cutter elements 50 on primary blades 31, 32, 33 allows for a greater degree of freedom in choosing the radial location of each backup cutter element 50—since primary blades 31, 32, 33 extend radially from proximal bit axis 11 to gage region 26, backup cutter elements 50 may be mounted at nearly any radial position on cutter-supporting surface 42 of each primary blade 31, 32, 33. For instance, one or more backup cutter elements may be positioned on cutter-supporting surface 42 in cone region 24, in shoulder region 25, in gage region 26, or combinations thereof. However, since secondary blades 34, 35, 36 do not extend significantly into cone region 24, any backup cutter elements (e.g., cutter elements 50) provided on secondary blades are limited to placement in shoulder region 25 and/or gage region 26. Thus, although other embodiments may include one or more backup cutter elements (e.g., backup cutter elements 50) on one or more secondary blades (e.g., secondary blades 34, 35, 36), it is preferred that the majority of any backup cutter elements are provided on the primary blades. In this way, bit 10 may also be described in terms of a "backup cutter ratio" defined herein as the ratio of the total number of backup cutter elements on all of the primary blades to the total number of backup cutter elements on all of the secondary blades. For the reasons described above, the backup cutter ratio is preferably greater than 1.0, and more preferably greater than 2.0. In the embodiment shown in FIG. 4, every backup cutter element 50 provided on bit 10 is mounted to a primary blade 31, 32, 33, and more specifically, six backup cutter elements 50 are provided on primary blades 31, 32, 33, and zero backup cutter elements 50 are provided on secondary blades 34, 35, 36. Thus, the backup cutter ratio for this embodiment is infinity (i.e., the ratio of six to zero is infinity).

Without being limited by this or any particular theory, the cutter elements of a fixed cutter bit positioned in the nose and shoulder regions of the bit tend to bear a majority of the weight on bit, and thus, tend to perform the bulk of the formation cutting and removal. Consequently, such cutter elements typically have the greatest impact on the overall ROP of the bit. Therefore, it is preferred that at least some of backup cutter elements 50 provided on bit 10 are positioned in nose and shoulder regions 25, 27. In the embodiment shown in FIG. 4, every backup cutter elements 50 on each primary blade 31, 32, 33 is positioned within shoulder region 25, and further, the radially innermost backup cutter elements 50 on each primary blade 31, 32, 33 is positioned proximal nose region 27. Consequently, embodiments of bit 10 include a greater total number of cutter elements 40, 50 in shoulder and nose regions 25, 27 as compared to a similar bit without backup cutter elements 50 in shoulder and nose regions 25, 27. Thus, embodiments of bit 10 offer the potential for increased formation removal and ROP as compared to a similar bit without backup cutter elements in the nose and shoulder regions. In other embodiments, backup cutter elements (e.g., backup cutter elements 50) may be provided in other regions of the bit such as the gage region.

Referring now to FIGS. 1, 2, and 4, each cutter element 40, 50 comprises an elongated and generally cylindrical support member or substrate which is received and secured in a pocket formed in the surface of the blade to which it is fixed. Cutting face 44, 54 of each cutter element 40, 50, respectively, comprises a disk or tablet-shaped, hard cutting layer of polycrystalline diamond or other superabrasive material is bonded to the exposed end of the support member. In the embodiments described herein, each cutter element 40, 50 is mounted such that cutting faces 44, 54, respectively, are forward-facing. As used herein, "forward-facing" is used to describe the orientation of a surface that is substantially perpendicular to or at an acute angle relative to the cutting direction of bit 10 represented by arrow 18. For instance, a forward-facing cutting face 44, 54 may be oriented perpendicular to the cutting direction of bit 10, may include a backrake angle, and/or may include a siderake angle. However, cutting faces 44, 54 are preferably oriented perpendicular to the direction of rotation of bit 10 plus or minus a 15° backrake angle and plus or minus a 45° siderake angle. In addition, each cutting face 44, 54 includes a cutting edge adapted to engage and remove formation material. Such cutting edge may be chamfered or beveled as desired. In this embodiment, cutting faces 44, 54 are substantially planar, but may be convex or concave in other embodiments. Each cutting face 44, 54 preferably extends to or within 0.080 in. (~2.032 mm) of the outermost cutting profile of bit 10 as will be explained in more detail below.

In the embodiment of bit 10 illustrated in FIG. 4, each cutter element 40, 50 has substantially the same size and geometry. However, in other embodiments, one or more primary cutter element (e.g., primary cutter element 40) and/or one or more backup cutter element (e.g., backup cutter element 50) may have a different size and/or geometry. For instance, each backup cutter element may have the same size and geometry, and each primary cutter element may have the same size and geometry that is different from each backup cutter elements. In general, each primary cutter element 40 and each backup cutter element 50 may have any suitable size and geometry.

Still referring to the embodiment shown in FIG. 4, each primary blade 31, 32, 33 and each secondary blade 34, 35, 36 generally tapers (e.g., becomes thinner) in top view as it extends radially inwards towards central axis 11. Consequently, primary blades 31, 32, 33 are relatively thin proximal axis 11 where space is generally limited circumferentially, and widen towards gage region 26, thereby creating additional space to accommodate both primary cutter elements 40 and backup cutter elements 50 on the same primary blade. Although primary blades 31, 32, 33 and secondary blades 34, 35, 36 illustrated in FIG. 4 extend substantially linearly in the radial direction in top view, in other embodiments, one or more of the primary blades, one or more secondary blades, or combinations thereof may be arcuate or curve along their length in top view.

As one skilled in the art will appreciate, numerous variations in the size, orientation, and locations of primary cutter elements 40, backup cutter elements 50, and depth-of-cut limiters 55 along one or more primary and/or secondary blade are possible. Certain features and variations of primary cutter elements 40 and backup cutter elements 50 of bit 10 may be best understood with reference to schematic enlarged top views of each primary blade 31, 32, 33 and secondary blade 34 described in more detail below. In addition, certain features and variations may be best understood with reference to rotated profile views, one associated with each enlarged schematic top view.

Figure 5A:
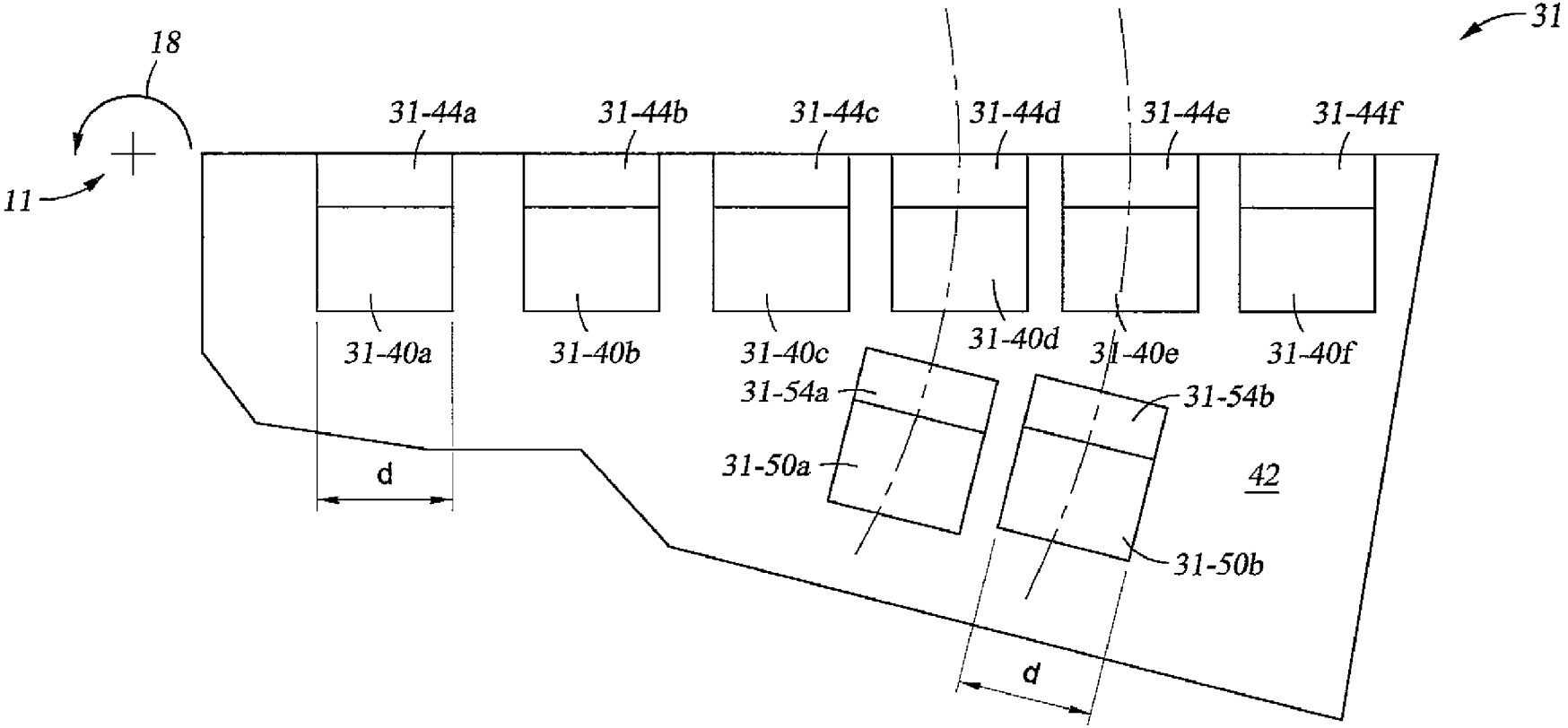
FIG. 5A is a schematic top view of one of the primary blades shown in FIG. 1.
Figure 5B:
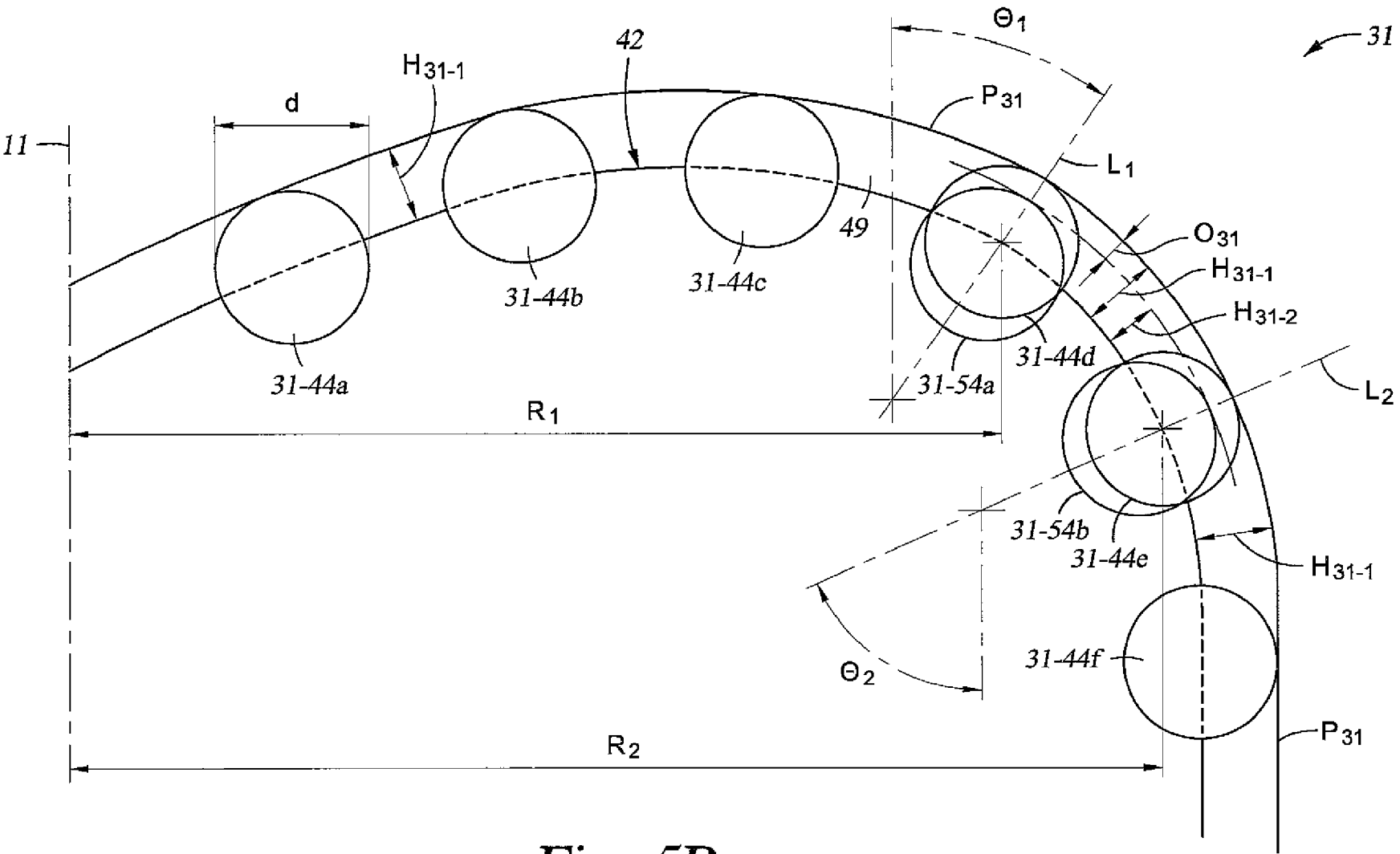
FIG. 5B is a schematic view showing the rotated profile of the primary blade shown in FIG. 5A.

FIG. 5A is an enlarged schematic top view of primary blade 31 and its associated primary cutter elements 40 and backup cutter elements 50. FIG. 5B schematically illustrates primary blade 31 and each cutter element 40, 50 mounted thereon rotated into a single rotated profile view.

Referring now to FIG. 5A, for purposes of clarity and further explanation, primary cutter elements 40 mounted to primary blade 31 are assigned reference numerals 31-40*a-f*, there being six primary cutter elements 40 mounted to cutter-supporting surface 42 of primary blade 31. Likewise, backup cutter elements 50 mounted to primary blade 31 are assigned reference numerals 31-50*a, b*, there being two backup cutter elements 50 mounted to cutter-supporting surface 42 of primary blade 31. Primary cutting faces 44 of primary cutter elements 31-40*a-f* are assigned reference numerals 31-44*a-f*, respectively, and backup cutting faces 54 of backup cutter elements 31-50*a, b* are assigned reference numerals 31-54*a, b*, respectively.

The row of backup cutter elements 31-50*a, b* is positioned behind, and trails, the row of primary cutter elements 31-40*a-f* provided on the same primary blade 31. In addition, as will be explained in more detail below, each backup cutter element 31-50*a, b* substantially tracks an associated primary cutter element 31-40*d, e*, respectively. In general, a cutter element that tracks another cutter element may be referred to as "redundant". In other embodiments, one or more backup cutter elements (e.g., backup cutter element 31-50*a*) may not substantially track an associated primary cutter element on the same blade (e.g., primary cutter elements 31-40*a-f*). Such a non-tracking backup cutter element may be described as being "staggered" or having a different radial position relative to the primary cutter elements on the same primary blade. Due to the size and placement of cutter elements 40, 50, coupled with space limitations on cutter-supporting surface 42 of primary blade 31, no depth-of-cut limiters are provided on primary blade 31.

Referring still to FIG. 5A, in this embodiment, primary cutter elements 31-50*a-f* and backup cutter elements 31-50*a, b* each have substantially the same cylindrical geometry and size. In particular, each primary cutting face 31-44*a-f* and each backup cutting face 31-54*a, b* has substantially the same diameter d. For an exemplary bit 10 having an overall gage diameter of 7.875 in. (~20 cm), diameter d of each cutting face 31-44*a-f* and 31-54*a, b* is about 0.625 in. (~16 mm). In other embodiments, the geometry of one or more primary cutting face and/or one or more backup cutting face may be different.

Referring now to FIG. 5B, the profiles of primary blade 31 and cutting faces 31-44*a-f* and 31-54*a, b* are shown rotated into a single rotated profile. In rotated profile view, primary blade 31 forms a blade profile 49 generally defined by the cutter-supporting surface 42 of primary blade 31. Each primary cutting face 31-44*a-f* extends to substantially the same extension height $H_{31-1}$ measured perpendicularly from cutter-supporting surface 42 of primary blade 31 to the outermost cutting tip of each cutting face 31-44*a-f*. Thus, as used herein, the phrase "extension height" may be used to refer to the distance or height to which a structure (e.g., cutting face, depth-of-cut limiter, etc.) extends perpendicularly from the cutter-supporting surface of the blade to which it is attached. Likewise, each backup cutting face 31-54*a, b* extends to substantially the same extension height $H_{31-2}$. In this embodiment, extension height $H_{31-2}$ of backup cutting faces 31-54*a, b* is less than extension height $H_{31-1}$ of primary cutting faces 31-44*a-f*. Thus, primary cutting faces 31-44*a-f* will tend to engage the formation before backup cutting faces 31-54*a, b*, and further, tend to engage a greater depth of formation as compared to backup cutting faces 31-54*a, b*.

The outermost or distal cutting tips of cutting faces 31-44*a-f* extending to extension height $H_{31-1}$ define an outermost cutting profile $P_{31}$. In this embodiment, each primary cutting face 31-44*a-f* extends to substantially the same first extension height $H_{31-1}$, thus, outermost cutting profile $P_{31}$ is substantially parallel to blade profile 49. Since extension height $H_{31-2}$ of backup cutting faces 31-54*a, b* is less than extension height $H_{31-1}$ defining outermost cutting profile $P_{31}$, backup cutting faces 31-54*a, b* may also be described as being "off profile." As used herein, the phrase "off profile" may be used to refer to a structure extending from the cutter-supporting surface (e.g., cutter element, depth-of-cut limiter, etc.) that has an extension height less than the extension height of one or more other cutter elements that define the outermost cutting profile of a given blade. In the embodiment of FIG. 5B, backup cutting faces 31-54*a, b* are offset from cutting profile $P_{31}$ by an offset distance $O_{31}$, where offset distance $O_{31}$ is equal to extension height $H_{31-1}$ minus extension height $H_{31-2}$. Offset distance $O_{31}$ is preferably less than 0.100 in. (~2.54 mm), and more preferably between 0.040 in. (~1.02 mm) and 0.060 in. (~1.52 mm).

The amount or degree of offset of backup cutting faces 31-54*a, b* relative to outermost cutting profile $P_{31}$ may also be expressed in terms of an offset ratio. As used herein, the phrase "offset ratio" may be used to refer to the ratio of the distance a cutting face is offset from the outermost cutting profile to the diameter d of the cutting face. The offset ratio is preferably between 0.020 and 0.200. In this exemplary embodiment, the offset ratio of backup cutting faces 31-54*a, b* relative to outermost cutting profile $P_{31}$ defined by primary cutting faces 31-44*a-f* is about 0.064.

As previously described, in this embodiment, each primary cutting face 44 is shown as having substantially the same extension height $H_{31-1}$ and each backup cutting face 54 is shown as having substantially the same extension height $H_{31-2}$ that is less than extension height $H_{31-1}$, resulting in uniform offset distances $O_{31}$. However, in other embodiments, the extension heights of each primary cutting face need not be the same, and further, the extension height of each backup cutting face need not be the same. It is to be understood that some such embodiments may result in a non-uniform offset distance between the cutting profile of the primary cutting faces and the backup cutting faces. Further, in some embodiments, the backup cutting faces (e.g., backup cutting faces 31-54*a, b*) may have the same extension height as the primary cutting faces (e.g., primary cutting faces 31-44*a-f*), resulting in an offset distance of zero. In such an arrangement, the backup cutting faces may be described as being "on profile" relative to the primary cutting faces on the same blade. In still other embodiments, one or more backup cutting face may have a greater extension height than one or more primary cutting face on the same blade.

Referring still to the rotated profile view of FIG. 5B, each backup cutting face 31-54*a, b* tracks an associated primary cutting face 31-44*d, e*, respectively. More specifically, each backup cutting face 31-54*a, b* is disposed on cutter-supporting surface 42 of primary blade 31 at substantially the same radial position (relative to bit axis 11) as its associated primary cutting face 31-44*d, e*, respectively.

In general, the radial position of a cutter element is defined by the radial distance from the bit axis to the point on the cutter supporting surface at which the cutter element is mounted. For instance, the radial position of primary cutting face 31-44*d* and backup cutting face 31-54*a* is defined by a radial distance $R_1$ measured perpendicularly from bit axis 11 to the point of intersection of blade profile 49 and profile angle line $L_1$. Profile angle line $L_1$ is perpendicular to blade profile 49 (and cutter-supporting surface 42), and passes through the center of primary cutting face 31-44*d* and backup cutting face 31-54*a*, thereby bisecting each. Further, profile angle line $L_1$ forms a profile angle $\theta_1$ measured between bit axis 11 (or a line parallel to bit axis 11) and first profile line $L_1$. Thus, as used herein, the phrase "profile angle line" may be used to refer to a line perpendicular to a blade profile or cutter-supporting surface in rotated profile view, and further, the phrase "profile angle" may be used to refer to the angle between a profile angle line and a line parallel to the bit axis in rotated profile view.

As another example, the radial position of primary cutting face 31-44*f* and backup cutting face 32-54*b* is defined by a radial distance $R_2$ measured perpendicularly from bit axis 11 to the point of intersection of blade profile 49 and profile angle line $L_2$. Profile angle line $L_2$ is perpendicular to blade profile 49 (and cutter-supporting surface 42), and passes through the center of primary cutting face 31-44*e* and backup cutting face 31-54*b*, thereby bisecting each. Further, profile angle line $L_2$ forms a profile angle $\theta_2$ measured between bit axis 11 (or a line parallel to bit axis 11) and first profile line $L_2$. Thus, as used herein, the phrase "radial position" refers to the position of a cutter element in rotated profile as measured perpendicularly from the bit axis to the intersection of the cutter-supporting surface or blade profile of the blade to which the cutter element is mounted and a line perpendicular to the cutter-supporting surface that passes through the center of the cutter element.

It should be appreciated that the same profile angle line $L_1$ perpendicular to blade profile 49 passes through the center of both primary cutting face 31-44*d* and backup cutting face 31-54*a*. In this sense, any two cutter elements at the same radial position may be described as lying along the same profile angle line in rotated profile view.

It is to be understood that cutter elements arranged in a radially extending row are disposed at different radial positions. Thus, each primary cutter element 31-40*a-f* on primary blade 31 has a different radial position, and each backup cutter element 31-40*a, b* has a different radial position.

In general, cutter elements disposed at the same radial position, on the same or different blades, are commonly referred to as "redundant" cutter elements. During rotation of the bit, redundant cutter elements follow in essentially the same path. The leading redundant cutter element tends to clear away formation material, allowing the trailing redundant element to follow in the path at least partially cleared by the preceding cutter element. As a result, during rotation the redundant cutter elements tend to be subjected to less resistance from the earthen material and less wear than the preceding element. The decrease in resistance reduces the stresses placed on the redundant cutter elements and may improve the durability of the element by reducing the likelihood of mechanical failures such as fatigue cracking.

Referring still to FIG. 5B, as a result of the relative sizes and radial positions of primary cutting faces 31-44*a-f* and backup cutting faces 31-54*a, b*, the cutting profile or path of each backup cutting face 31-54*a, b* is substantially eclipsed or overlapped by the cutting profile or path of its associated primary cutting face 31-44*d, e*, respectively. More specifically, in this embodiment the profile of each backup cutting face 31-54*a, b* is completely eclipsed by the profile of its associated primary cutting face 31-44*d, e*. In other embodiments, the cutting profile of one or more backup cutting face may be partially eclipsed or not eclipsed at all by the cutting profile of a primary cutting face on the same blade.

Figure 6A:
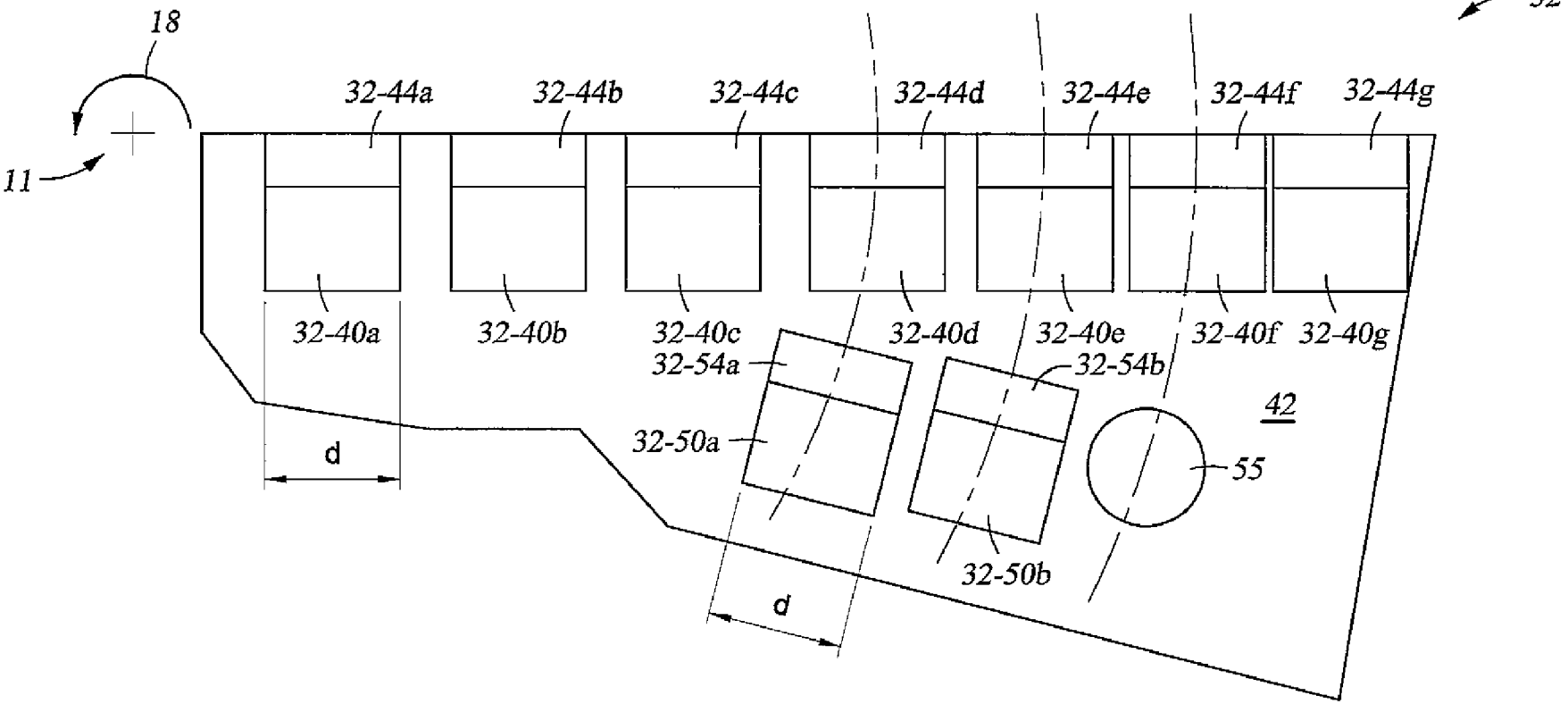
FIG. 6A is a schematic top view of another primary blade shown in FIG. 1.
Figure 6B:
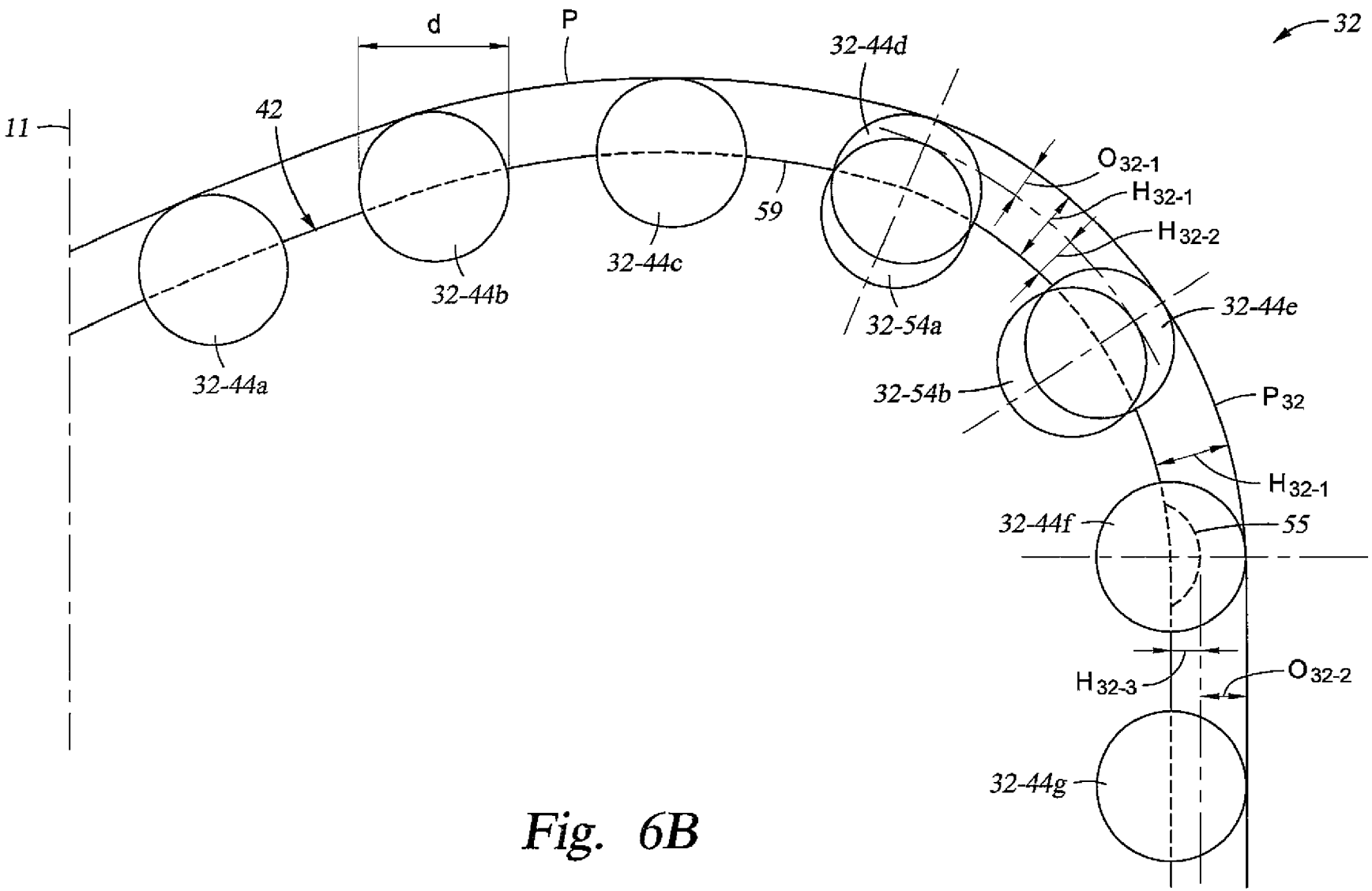
FIG. 6B is a schematic view showing the rotated profile of the primary blade shown in FIG. 6A.

FIG. 6A is an enlarged schematic top view of primary blade 32 and its associated primary cutter elements 40 and backup cutter elements 50. FIG. 6B schematically illustrates primary blade 32 and each of its associated primary cutter elements 40 and backup cutter elements 50 rotated into a single rotated profile view.

Referring now to FIG. 6A, for purposes of clarity and further explanation, primary cutter elements 40 mounted to primary blade 32 are assigned reference numerals 32-40*a-g*, there being seven primary cutter elements 40 mounted to cutter-supporting surface 42 of primary blade 32. Likewise, backup cutter elements 50 mounted to primary blade 32 are assigned reference numerals 32-50*a, b*, there being two backup cutter elements 50 mounted to cutter-supporting surface 42 of primary blade 32. Primary cutting faces 44 of primary cutter elements 32-40*a-g* are assigned reference numerals 32-44*a-g*, respectively, and backup cutting faces 54 of backup cutter elements 32-50*a, b* are assigned reference numerals 32-54*a, b*, respectively.

Primary blade 32 is configured similarly to primary blade 31 previously described. However, primary blade 32 includes seven primary cutter elements 32-44*a-g* and a depth-of-cut limiter 55. Namely, primary cutter elements 32-40*a-g* are arranged in a radially extending row on primary blade 32. Further, backup cutter elements 32-50*a, b* are also arranged in a radially extending row on primary blade 32. Each backup cutter element 32-50*a, b* is positioned behind, and at the same radial position its associated primary cutter element 32-40*d, e*, respectively. However, cutting faces 32-44*a-g*, 32-54*a, b* are staggered (i.e., disposed at different radial positions) relative cutting faces 31-44*a-f*, 31-54*a, b* of primary blade 31.

In this embodiment, primary cutter elements 32-50*a-g* and backup cutter elements 32-50*a, b* each have the same cylindrical geometry and size as cutter elements 40, 50 on primary blade 31 previously described. Consequently, primary cutting faces 32-44*a-g* and backup cutting faces 32-54*a, b* each have a uniform diameter d. However, in other embodiments, one or more primary or backup cutter elements on different blades may have different geometries and/or sizes.

Primary blade 32 also includes depth-of-cut limiter 55, which extends from cutter-supporting surface 42. In this embodiment, depth-of-cut limiter 55 is generally positioned in line with the row of backup cutter elements 32-50*a, b*, and further, depth-of-cut limiter 55 is disposed at substantially the same radial position as an associated primary cutter element 32-40*f*.

Referring now to FIG. 6B, the profile of primary blade 32, the profile of cutting faces 32-44*a-g* and 32-54*a, b*, and the profile of depth-of-cut limiter 55 are shown rotated into a single rotated profile. In rotated profile view, primary blade 32 forms a blade profile 59 generally defined by the cutter-supporting surface 42 of primary blade 32.

Each primary cutting face 32-44*a-g* extends to an extension height $H_{32-1}$. The outermost or distal cutting tips of primary cutting faces 32-44*a-g* extending to extension height $H_{32-1}$ define an outermost cutting profile $P_{32}$ for primary blade 32. Outermost cutting profile $P_{32}$ is substantially parallel to cutter-supporting surface 42 and blade profile 59 of primary blade 32 in rotated profile view. In addition, each backup cutting face 32-54*a, b* extends to an extension height $H_{32-2}$. In this embodiment, second extension height $H_{32-2}$ of backup cutting faces 32-54*a, b* is less than first extension height $H_{32-1}$ of primary cutting faces 32-44*a-g*. Thus, backup cutting faces 32-54*a, b* are off profile by a uniform offset distance $O_{32-1}$. Still further, depth-of-cut limiter 55 extends to an extension height $H_{32-3}$. In this embodiment, extension height $H_{32-3}$ of depth-of-cut limiter 55 is less than second extension height $H_{32-2}$ and less than first extension height $H_{32-1}$. Thus, depth-of-cut limiter 55 is off profile by an offset distance $O_{32-2}$. Offset distance $O_{32-2}$ of depth-of-cut limiter 55 is preferably less than 0.150 in. (~3.81 mm).

Referring still to the rotated profile view of FIG. 6B, primary cutting face 32-44*d* and backup cutting face 32-54*a* are disposed at substantially the same radial position relative to bit axis 11, each lying along the same profile angle line in rotated profile view. Likewise primary cutting face 32-44*e* and backup cutting face 32-54*b* are disposed at substantially the same radial position relative to bit axis 11, each lying along the same profile angle line in rotated profile view. In rotated profile view, the cutting profile or path of each backup cutting face 32-54*a, b* is substantially eclipsed by the cutting profile or path of its associated primary cutting face 32-44*d, e*, respectively.

Figure 7A:
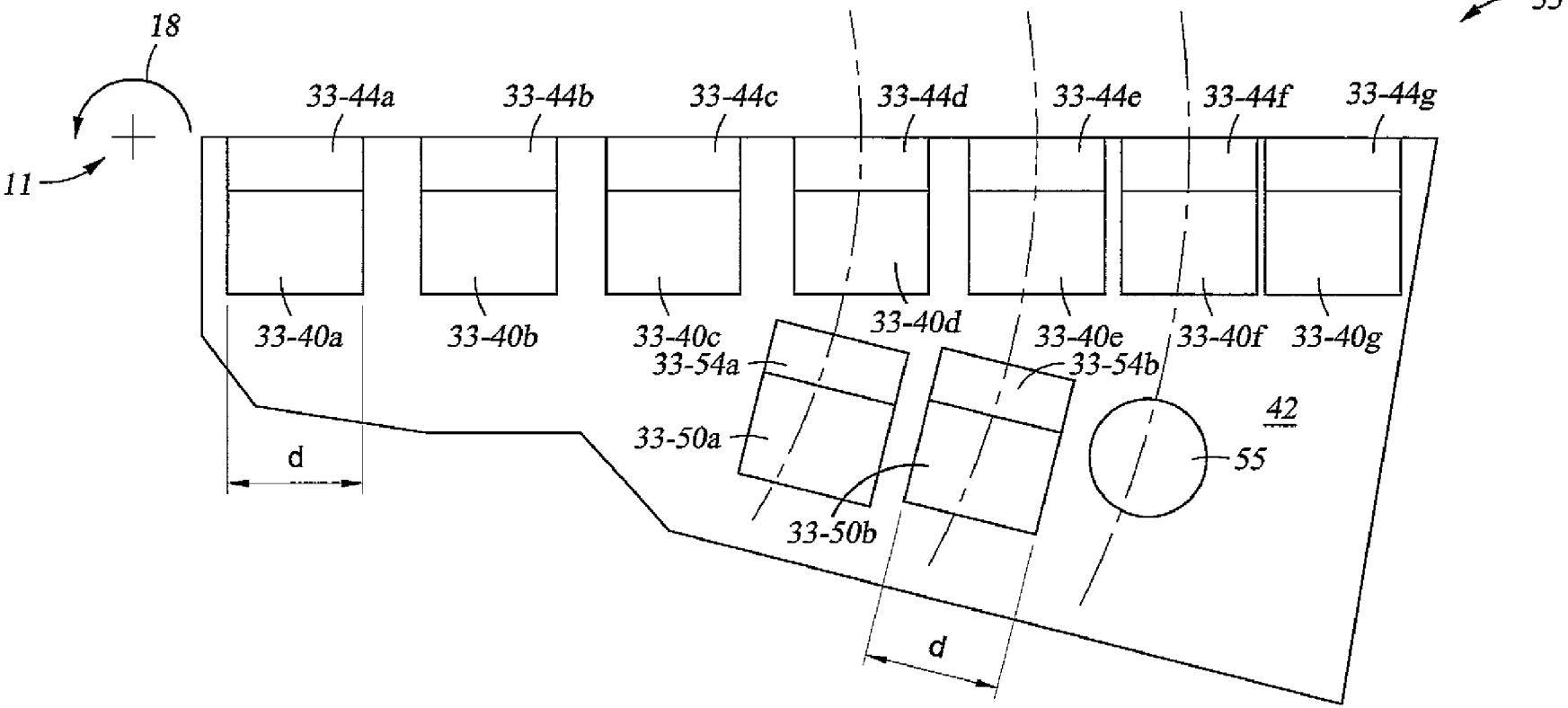
FIG. 7A is a schematic top view of another primary blade shown in FIG. 1.
Figure 7B:
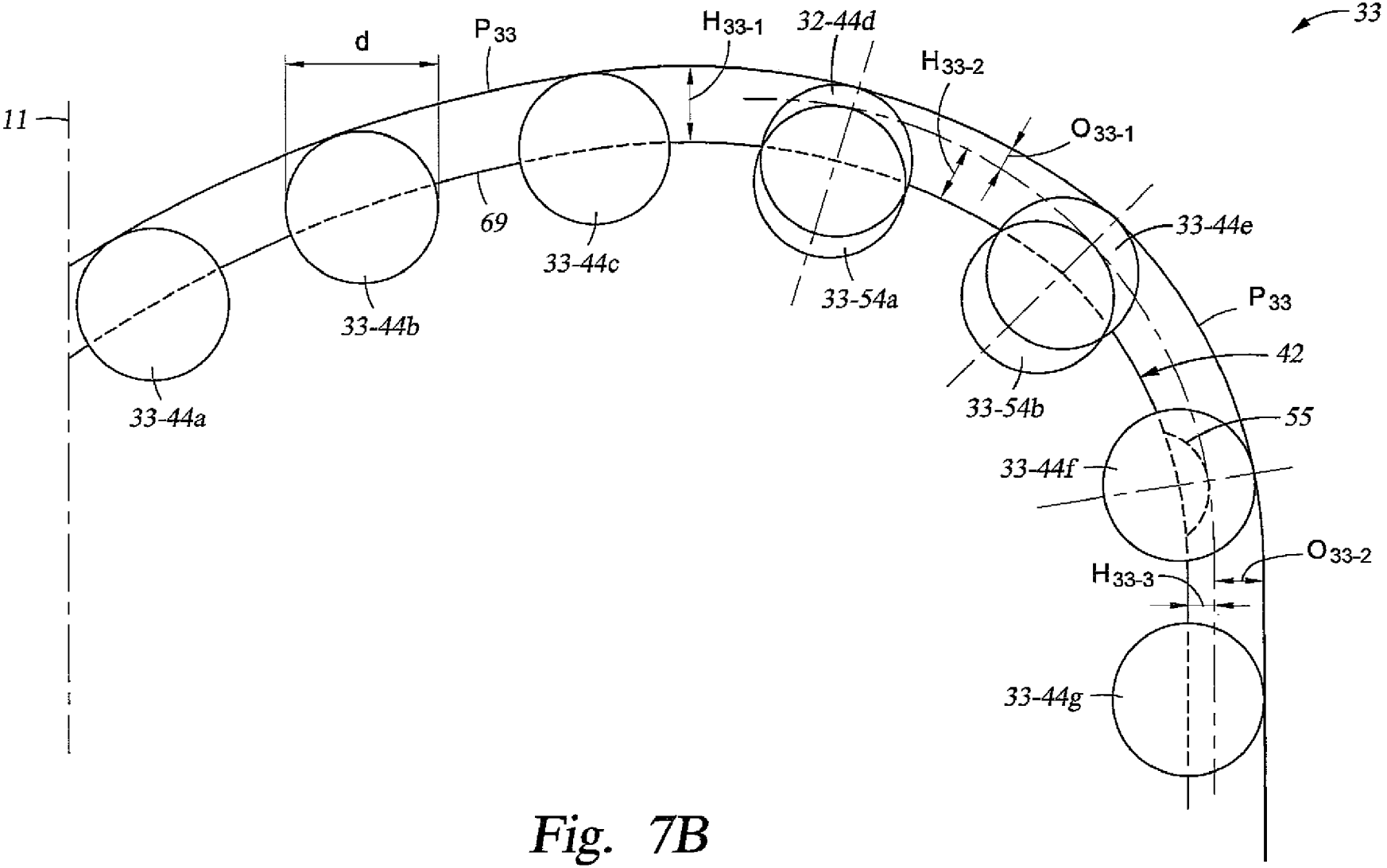
FIG. 7B is a schematic view showing the rotated profile of the primary blade shown in FIG. 7A.

FIG. 7A is an enlarged schematic top view of primary blade 33 and its associated primary cutter elements 40 and backup cutter elements 50. FIG. 7B schematically illustrates primary blade 33 and each of its associated primary cutter elements 40 and backup cutter elements 50 rotated into a single rotated profile view.

Referring now to FIG. 7A, for purposes of clarity and further explanation, primary cutter elements 40 mounted to primary blade 33 are assigned reference numerals 33-40*a-g*, there being seven primary cutter elements 40 mounted to cutter-supporting surface 42 of primary blade 33. Likewise, backup cutter elements 50 mounted to primary blade 33 are assigned reference numerals 33-50*a, b*, there being two backup cutter elements 50 mounted to cutter-supporting surface 42 of primary blade 33. Primary cutting faces 44 of primary cutter elements 33-40*a-g* are assigned reference numerals 33-44*a-g*, respectively, and backup cutting faces 54 of backup cutter elements 33-50*a, b* are assigned reference numerals 33-54*a, b*, respectively.

Primary blade 33 is configured similarly to primary blade 32 previously described. Namely, primary cutter elements 33-40*a-g* are arranged in a radially extending row. Further, backup cutter elements 33-50*a, b* are arranged in a radially extending row. Each backup cutter element 33-50*a, b* is positioned behind, and at the same radial position, as an associated primary cutter element 33-40*d, e*, respectively, on the same primary blade 33. However, cutting faces 33-44*a-g*, 33-54*a, b* are staggered (i.e., disposed at different radial positions) relative cutting faces 31-44*a-f*, 31-54*a, b* of primary blade 31 and cutting faces 32-44*a-g*, 32-54*a, b* of primary blade 32.

In this embodiment, primary cutter elements 33-50*a-g* and backup cutter elements 33-50*a, b* each have the same cylindrical geometry and size as cutter elements 40, 50 on primary blades 31, 32 previously described. Consequently, primary cutting faces 33-44*a-g* and backup cutting faces 33-54*a, b* each have a uniform diameter d.

Primary blade 33 also includes depth-of-cut limiter 55, which extends from cutter-supporting surface 42. In this embodiment, depth-of-cut limiter 55 is generally positioned in line with the row of backup cutter elements 33-50*a, b*. In addition, in this embodiment, depth-of-cut limiter 55 is disposed at substantially the same radial position as an associated primary cutter element 33-40*f*.

Referring now to FIG. 7B, the profile of primary blade 33, the profile of cutting faces 33-44*a-g* and 33-54*a, b*, and the profile of depth-of-cut limiter 55 are shown rotated into a single rotated profile. In rotated profile view, primary blade 33 forms a blade profile 69 generally defined by the cutter-supporting surface 42 of primary blade 33. Each primary cutting face 33-44*a-g* extends to an extension height $H_{33-1}$. The outermost or distal cutting tips of primary cutting faces 33-44*a-g* extending to extension height $H_{32-1}$ define an outermost cutting profile $P_{33}$ that is substantially parallel to cutter-supporting surface 42 and blade profile 59 of primary blade 33 in rotated profile view. In addition, each backup cutting face 33-54*a, b* extends to an extension height $H_{33-2}$. In this embodiment, extension height $H_{33-2}$ of backup cutting faces 33-54*a, b* is less than extension height $H_{33-1}$ of primary cutting faces 33-44*a-g*. Thus, backup cutting faces 33-54*a, b* are off profile by an offset distance $O_{33}$. Still further, depth-of-cut limiter 55 extends to an extension height $H_{33-3}$. In this embodiment, extension height $H_{33-3}$ is less than second extension height $H_{33-2}$ and less than first extension height $H_{33-1}$. Thus, depth-of-cut limiter 55 is off profile by an offset distance $O_{33-2}$. Offset distance $O_{33-2}$ of depth-of-cut limiter 55 is preferably less than 0.150 in. (~3.81 mm).

Referring still to the rotated profile view of FIG. 7B, primary cutting face 33-44*d* and backup cutting face 33-54*a* are disposed at substantially the same radial position relative to bit axis 11, each being bisected by the same profile angle line in rotated profile view. Likewise primary cutting face 33-44*e* and backup cutting face 33-54*b* are disposed at substantially the same radial position relative to bit axis 11, each being bisected by the same profile angle line in rotated profile view. In rotated profile view, the cutting profile or path of each backup cutting face 33-54*a, b* is substantially eclipsed by the cutting profile or path of its associated primary cutting face 33-44*d, e*, respectively.

Figure 8:
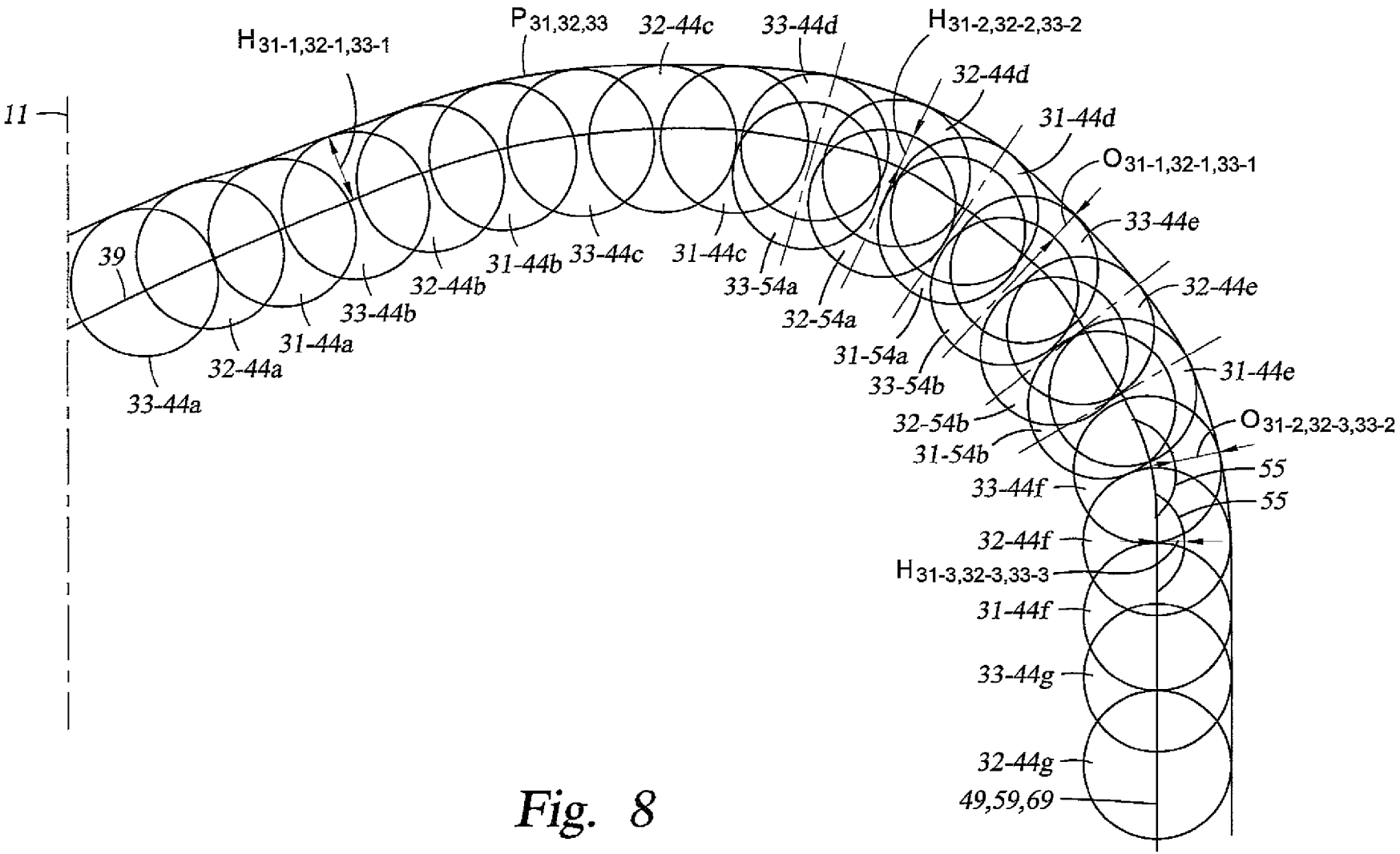
FIG. 8 is an enlarged schematic view showing the rotated profile of all of the primary blades shown in FIG. 1.

Referring now to FIG. 8, a schematic view of all primary blades 31, 32, 33, and cutter elements 40, 50 mounted thereon, rotated into a single rotated profile is shown. In this embodiment, blade profiles 49, 59, 69 of primary blades 31, 32, 33, respectively, are substantially the same, each being coincident with each other and with composite blade profile 39 previously described (FIG. 3). In addition, in this embodiment, extension height $H_{31-1}$ of primary cutting faces 31-44*a-f*, extension height $H_{32-1}$ of primary cutting faces 32-44*a-g*, and extension height $H_{33-1}$ of primary cutting faces 33-44*a-g* are each substantially the same. Consequently, outermost cutting profiles $P_{31}$, $P_{32}$, $P_{33}$ of primary blades 31, 32, 33, respectively, overlap. Likewise, extension height $H_{31-2}$ of backup cutting face 31-54*a, b*, extension height $H_{32-2}$ of backup cutting faces 32-54*a, b*, and extension height $H_{33-2}$ of backup cutting faces 33-54*a, b* are each substantially the same. As a result, offset distances $O_{31-1}$, $O_{32-1}$, and $O_{33-1}$ of backup cutting faces on primary blades 31, 32, 33, respectively, are each substantially the same. Still further, extension height $H_{32-3}$ and $H_{33-3}$ of depth-of-cut limiters 55 are each substantially the same. Consequently offset distances $O_{32-2}$ and $O_{33-2}$ of depth of cut limiters 55 on primary blades 32, 33, respectively, are each substantially the same.

Referring still to FIG. 8, primary cutter elements 31-40*a-f* disposed on primary blade 31, primary cutter elements 32-40*a-g* disposed on primary blade 32, and primary cutter elements 33-40*a-g* disposed on primary blade 33 are staggered relative to each other. In other words, primary cutter elements 31-40*a-f*, 32-40*a-g* and 33-40*a-g* each have different radial positions relative to each other. Specifically, primary cutter elements 31-40*a-f* are positioned between primary cutter elements 32-40*a-g* and 33-40*a-g*, primary cutter elements 32-40*a-g* are positioned between primary cutter elements 31-40*a-f* and 33-40*a-g*, and primary cutter elements 33-40*a-g* are positioned between primary cutter elements 31-40*a-f* and 32-40*a-g*. As a result, in rotated profile, each primary cutting face 31-44*a-f* on primary blade 31 fills a gap created between primary cutting faces 32-44*a-g* and 33-44*a-g* on primary blades 32, 33, respectively; each primary cutting face 32-44*a-g* on primary blade 32 fills a gap created between primary cutting faces 31-44*a-f*, 33-44*a-g* on primary blades 31, 33, respectively; and, each primary cutting face 33-44*a-g* on primary blade 33 fills a gap created between primary cutting faces 31-44*a-f*, 31-44*a-g* on primary blades 31, 32, respectively.

As commonly described in the art, each primary blade 31, 32, 33 is a "single set" blade (i.e., a blade which comprise an arrangement of cutter elements having radial positions that are different from the cutter elements on every other blade on the bit). The inclusion of several single set blades enhances the durability of the bit by providing a large number of cutters that actively remove formation material to form the wellbore. By providing a large number of active cutters, the amount of work that is performed by the each cutter is minimized and the stresses placed on each active cutter are also reduced. This reduces the likelihood of a mechanical failure for the active cutters and enhances the durability of the bit.

In addition, since each backup cutter element 50 is disposed at substantially the same radial position as an associated primary cutter element 40 on the same blade, backup cutter elements 50 on different primary blades 31, 32, 33 occupy different radial positions. In other words, in this embodiment, no two cutter elements 40, 50 on different primary blades have the same radial position. In other embodiments, one or more primary cutter element and/or one or more backup cutter element on different primary blades may be disposed at the same radial position, and thus, be described as redundant cutter elements.

As previously shown in FIGS. 5B, 6B, and 7B, the profiles of primary cutting faces 44 on a given primary blade 31, 32, 33 do not overlap or eclipse each other in rotated profile view. However, as best seen in FIG. 8, the profile of each primary cutting face 44 at least partially eclipses the profile of another primary cutting face 44 disposed on a different primary blade 31, 32, 33. For instance, the profile of primary cutting face 31-44*a* of primary blade 31 partially eclipses the profile of primary cutting face 32-44*a* of primary blade 32 and partially eclipses the profile of primary cutting face 33-44*b* of primary blade 33.

Likewise, as previously shown in FIGS. 5B, 6B, and 7B, the profiles of backup cutting faces 54 on each primary blade 31, 32, 33 do not overlap or eclipse each other. However, as best seen in FIG. 8, the profile of each backup cutting face 54 at least partially eclipses the profile of one other backup cutting face 54 on a different primary blade 31, 32, 33. For instance, the profile of backup cutting face 31-54*a* of primary blade 31 partially eclipses the profile of backup cutting face 32-54*a* of primary blade 32 and partially eclipses the profile of backup cutting face 33-54*b* of primary blade 33. It should be appreciated that depending on a variety of factors including without limitation the size, location, and arrangement of backup cutter elements and primary cutter elements, each primary cutter element may substantially eclipse, partially eclipse, or not eclipse one or more primary cutter elements disposed on different blades.

In general, cutter elements 40, 50 are preferably spaced and oriented so as to maximize the bottomhole coverage of bit 10. For instance, in the embodiment of bit 10 shown in FIG. 8, the positioning of cutter elements 40, 50 at a variety of radial positions from cone region 24 to gage region 26 is intended to maximize the bottomhole coverage of bit 10. Further, the overlap the profiles of cutting faces 44, 54 in rotated profile is intended to reduce the size and number of ridges of uncut formation between adjacent cutting faces 44, 54. Such ridges of uncut formation may undesirably lead to tracking and/or detrimentally impact ROP.

Although each cutter element 40, 50 shown in FIGS. 5A, 6A, 7A, and 8 has substantially the same geometry and size, in other embodiments the geometry and/or size of one or more cutter elements on the same or different blades may vary.

FIG. 9A is an enlarged schematic top view of exemplary secondary blade 34 and its associated primary cutter elements 40. FIG. 7B schematically illustrates secondary blade 34 and each of its associated primary cutter elements 40 rotated into a single rotated profile view.

Referring now to FIG. 9A, in this embodiment, secondary blade 34 includes four primary cutter elements 40 arranged adjacent one another in a first row extending radially along secondary blade 34. As previously described, secondary blade 34 is substantially free of backup cutter elements. However, secondary blade 34 includes a depth-of-cut limiter 55 that trails, and is positioned at substantially the same radial position as one of the primary cutter elements 40.

Primary cutter elements 40 on secondary blade 34 are arranged in a row, each having a different radial position. Unlike primary blades 31, 32, 33 previously described, secondary blade 34 does not include any backup cutter elements in this embodiment. In other embodiments, one or more secondary blades may include backup cutter elements, however, the backup cutter ratio as previously described is preferably greater than 1.0, and more preferably greater than 2.0.

In this embodiment, primary cutter elements 40 on secondary blade 34 each have the same cylindrical geometry and size as cutter elements 40, 50 on primary blades 31, 32, 33 previously described. Consequently, primary cutting faces 44 of primary cutter elements 40 on secondary blade 34 each have a uniform diameter d. In other embodiments, one or more primary cutter element (e.g., primary cutter element 40) on a secondary blade (e.g., secondary blade 34) may have a different geometry and/or size as compared to another cutter element (e.g., primary cutter element or backup cutter element) on the same or different blade (e.g., primary blade or secondary blade).

Secondary blade 34 also includes one depth-of-cut limiter 55, which extends from cutter-supporting surface 52. In this embodiment, depth-of-cut limiter 55 is disposed at substantially the same radial position as an associated primary cutter element 40.

Figure 9B:
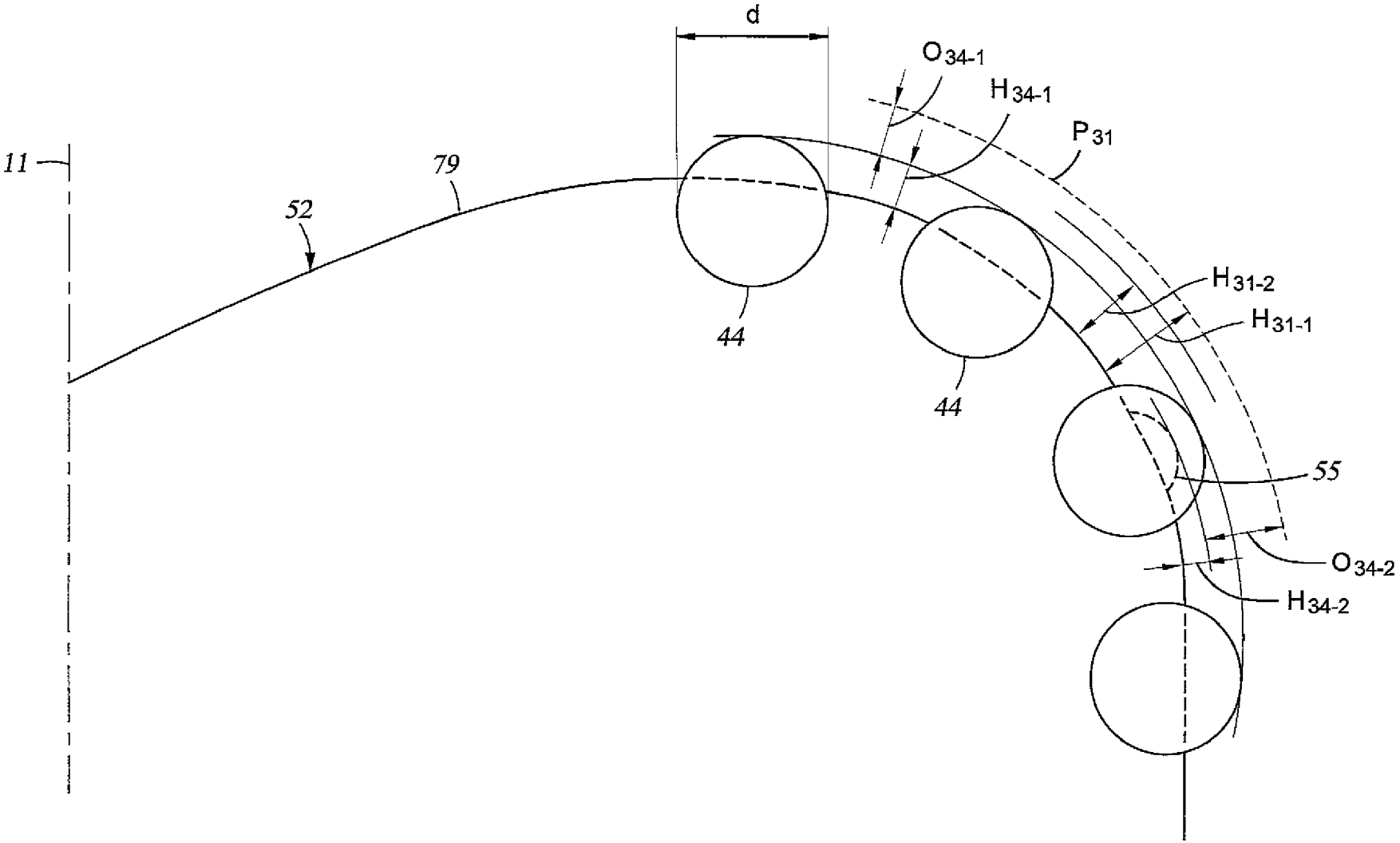
FIG. 9B is a schematic view showing the rotated profile of the secondary blade shown in FIG. 9A.

Referring now to FIG. 9B, the profile of secondary blade 34 and the profiles of cutting faces 44 and depth-of-cut limiter 55 mounted thereon are shown rotated into a single rotated profile. In rotated profile view, secondary blade 34 forms a blade profile 79 generally defined by the cutter-supporting surface 52 of secondary blade 34. In this embodiment, blade profile 79 is coincident with primary blade profiles 49, 59, 69 and composite blade profile 3 (FIG. 3) previously described. Each primary cutting face 44 extends to an extension height $H_{34\text{-}1}$. In this embodiment, extension height $H_{34\text{-}1}$ is less than extension height $H_{31\text{-}1}$ of primary cutting faces 31-44*a-f* previously described, and less than extension height $H_{31\text{-}2}$ of backup cutting faces 31-54*a, b* previously described. Thus, primary cutting faces 44 of primary cutter elements 40 on secondary blade 34 are off profile relative to cutting profile $P_{31}$ previously described (shown as dashed line). Specifically, primary cutting faces 44 are offset from cutting profile $P_{31}$ by an offset distance $O_{34\text{-}1}$. Offset distance $O_{34\text{-}1}$ is preferably less than 0.100 in. (~2.54 mm), and more preferably between 0.040 in. (~1.02 mm) and 0.060 in. (~1.52 mm). Further, the offset ratio of cutting faces 44 on secondary blade 34 is preferably 0.020 and 0.200.

Secondary blade 34 also includes a depth-of-cut limiter 55 having an extension height $H_{34\text{-}2}$ that is less than first extension height $H_{34\text{-}1}$. Depth-of-cut limiter 55 is off profile by an offset distance $O_{34\text{-}2}$ relative to outermost cutting profile $P_{31}$. Offset distance $O_{34\text{-}2}$ of depth-of-cut limiter 55 is preferably less than 0.150 in. (~3.81 mm). In addition, each depth-of-cut limiter 55 on bit 10 preferably has substantially the same extension height. In this embodiment of bit 10, each depth-of-cut limiter 55 has substantially the same extension height.

In this embodiment, the row of primary cutter elements 40 on secondary blade 34 are staggered (i.e., have different radial positions) relative to the primary cutter elements 40 on the other primary blades 31, 32, 33. In addition, the row of primary cutter elements 40 on secondary blade 34 are staggered relative to the primary cutter elements 40 on the other secondary blades 35, 36, thereby offering the potential to enhance the bottomhole coverage of bit 10, and reduce the formation of uncut ridges between adjacent cutter elements in rotated profile.

Remaining secondary blades 35, 36 are configured substantially the same as exemplary secondary blade 34 with the exception that the rows of primary cutter elements 40 on each secondary blade 34, 35, 36 are staggered relative to each other. However, in other embodiments, one or more primary cutter elements on one or more secondary blade may be positioned at the same radial position as one or more cutter elements (e.g., primary cutter elements or backup cutter elements) on another blade (e.g., primary blade or secondary blade).

Figure 10:
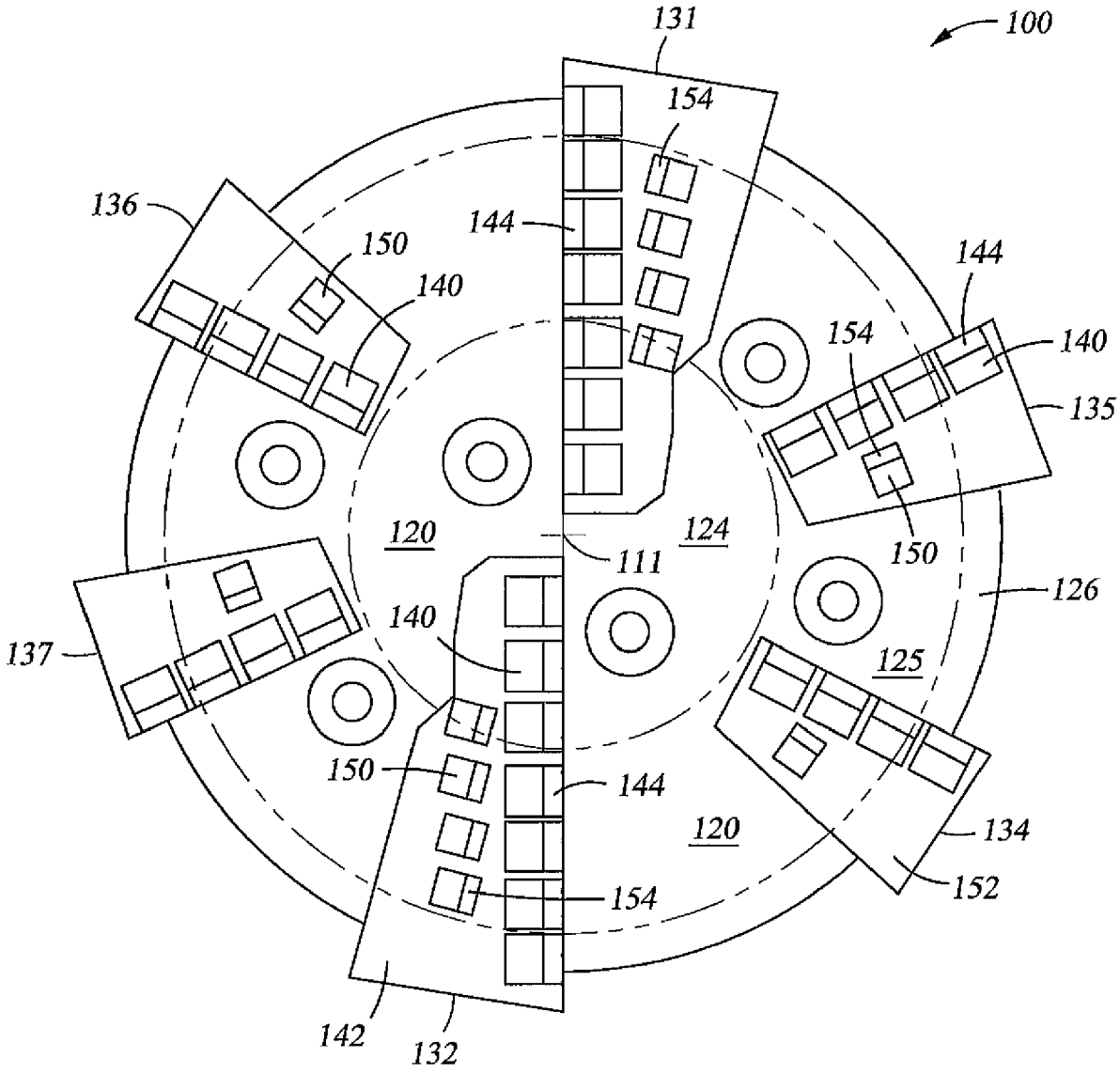
FIG. 10 is a schematic top view of an embodiment of a bit made in accordance with the principles described herein.
Figure 11:
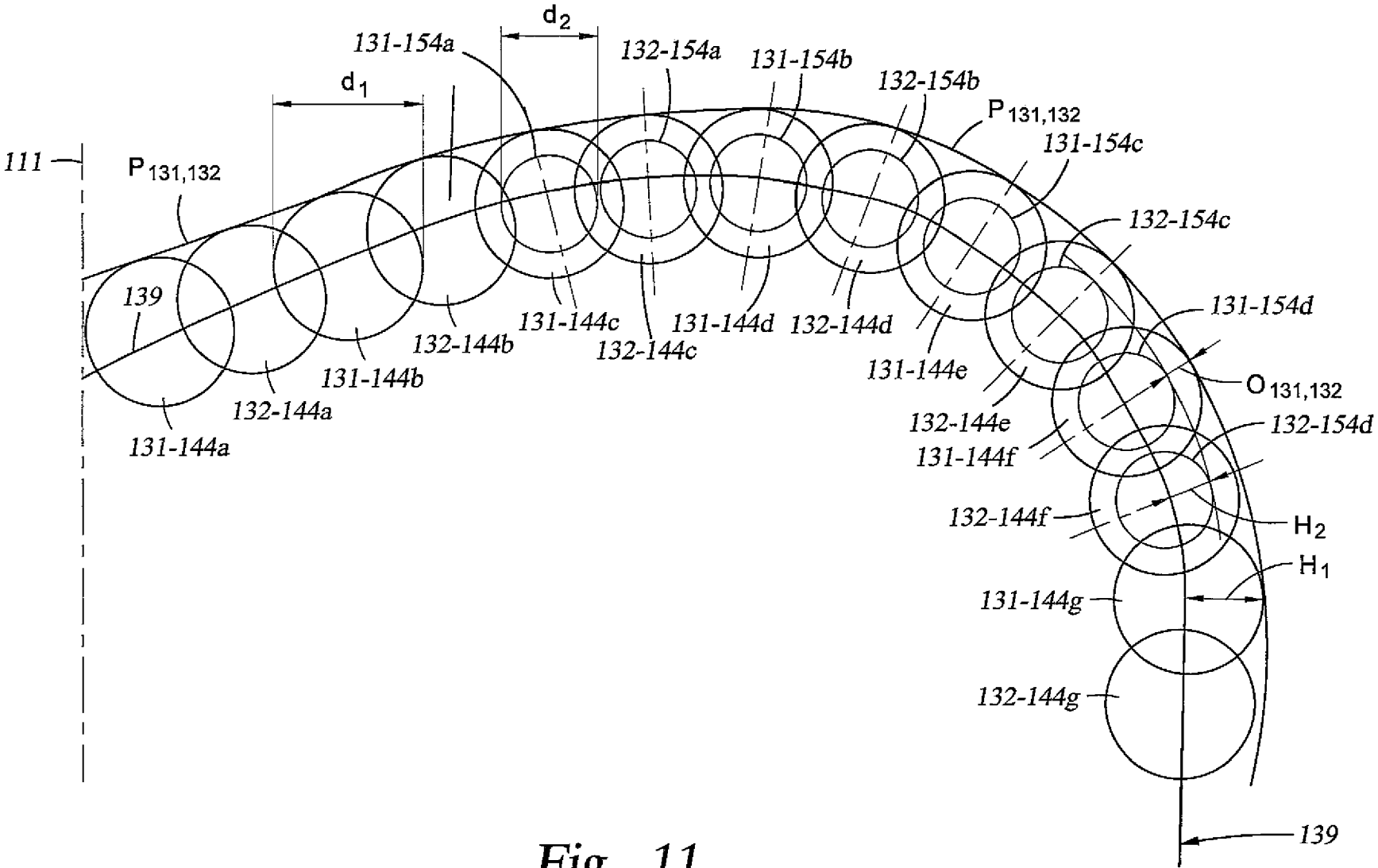
FIG. 11 is a schematic view showing the rotated profile of the primary blades shown in FIG. 10.

FIGS. 10 and 11 schematically illustrate another embodiment of a bit 100 constructed in accordance with the principles described herein. Specifically, FIG. 10 is a schematic top view of bit 100 and FIG. 11 is a schematic rotated profile view of the primary blades and cutter elements mounted thereon.

Referring now to FIG. 10, exemplary bit 100 has a central axis 111 and a bit face 120. Two angularly spaced-apart primary blades 131, 132 and four angularly spaced apart secondary blades 134, 135, 136, 137 extend radially along bit face 120. In this embodiment, the plurality of blades (e.g., primary blades 131, 132 and secondary blades 134, 135, 136, 137) are uniformly angularly spaced on bit face 120 about bit axis 111.

Moving radially outward from bit axis 111, bit face 120 may generally be divided into a cone region 124, shoulder region 125, and gage region 126. The transition between cone region 124 and shoulder region 125 occurs at the axially outermost portion of composite blade profile 139, which is typically referred to as the nose or nose region 127. In this embodiment, cone region 124 extends from central axis 111 to about 40% of the outer radius of bit 100 defining the full-gage diameter. In addition, in this embodiment, cone region 124 may also be defined by the radially innermost end of each secondary blade 134, 135, 136, 136.

A plurality of primary cutter elements 140, each having a primary cutting face 144, are mounted to the cutter-supporting surface 142 of each primary blade 131, 132 and mounted to the cutter-supporting surface 152 of each secondary blade 134, 135, 136, 137. In addition, one or more backup cutter elements 150, each having a backup cutting face 154, are mounted to each primary blade 131, 132 and each secondary blade 134, 135, 136, 137. Thus, contrary to bit 10 previously described, bit 100 includes a backup cutter element 150 on each secondary blade 134, 135, 136, 137. Each cutting face 144, 154 is forward-facing and includes a cutting edge adapted to engage and remove formation material. In general, primary cutter elements 140 are radially positioned within cone region 124, shoulder region 125, and gage region 126. However, in the embodiment shown in FIG. 10, every backup cutter elements 150 is positioned within shoulder region 125.

On each blade (e.g., primary blade 131, 132, secondary blade 134, 135, 136, 137, etc.) the primary cutter elements 140 and backup cutter elements 150 are generally arranged in a radially extending rows. Backup cutter elements 150 are positioned behind the primary cutter elements 140 on the same blade. As will be explained in more detail below, each backup cutter element 150 substantially tracks an associated primary cutter element 140 on the same blade.

In this embodiment, seven primary cutter elements 140 are provided on each primary blade 131, 132, and four primary cutter elements 140 are provided on each secondary blade 134, 135, 136, 137. In addition, in this embodiment, four backup cutter elements 150 are provided on each primary blade 131, 132, and one backup cutter element is provided on each secondary blade 134, 135, 136, 137. As previously described, the backup cutter ratio of embodiments described herein is preferably greater than 1.0, and more preferably greater than 2.0. In this particular embodiment, the backup cutter ratio is 2.0 (a total of eight backup cutter elements 150 on primary blades 131, 132 and a total of four backup cutter elements 150 on secondary blades 134, 135, 136, 137).

Referring still to FIG. 10, each primary cutter element 140 and each backup cutter element 150 is generally cylindrical. Each primary cutter element 140 has substantially the same size and geometry, and further, each backup cutter element 150 has substantially the same size and geometry. However, in this embodiment, backup cutter elements 150 are smaller than primary cutter elements 140. Consequently, cutting faces 154 have a smaller diameter than cutting faces 144.

Referring now to FIG. 11, the profiles of primary blades 131, 132 and associated cutting faces 144 and 154 are shown rotated into a single rotated profile. For purposes of clarity and further explanation, primary cutting faces 144 of primary cutter elements 140 mounted to primary blades 131, 132 are assigned reference numerals 131-144*a-g*, 132-144*a-g*, respectively, and backup cutting faces 154 of backup cutter elements 150 mounted to primary blades 131, 132 are assigned reference numerals 131-154*a-d*, 132-154*a-d*, respectively. For purposes of clarity, secondary blades 134, 135, 136, 137 and associated cutter elements 140, 150 are not shown in FIG. 11.

Primary cutting faces 131-144*a-g*, 132-144*a-g* each have substantially the same diameter $d_1$, and backup cutting faces 131-154*a-d*, 132-154*a-d*, each having substantially the same diameter $d_2$. However, as previously described, diameter $d_2$ of backup cutting faces 131-154*a-d*, 132-154*a-d* is less than diameter $d_1$ of 131-144*a-g*, 132-144*a-g* in this embodiment.

In rotated profile view, primary blades 131, 132 have substantially the same blade profiles that form a composite blade profile 139 generally defined by the cutter-supporting surfaces 142 of primary blades 131, 132. Primary cutting faces 131-144*a-g*, 132-144*a-g* on primary blades 131, 132, respectively, each extend to substantially the same extension height $H_1$ that defines the outermost cutting profile $P_{132,\ 132}$ of primary blades 131, 132. Likewise, backup cutting faces 131-154*a-d*, 132-154*a-d* of primary blades 131, 132 each extend to substantially the same extension height $H_2$. Similar to the embodiment of bit 10 previously described, in this embodiment, extension height $H_2$ of backup cutting faces 131-154*a-d*, 132-154*a-d* is less than extension height $H_1$ of primary cutting faces 131-144*a-g*, 132-144*a-g*. Thus, backup cutting faces 131-154*a-d*, 132-154*a-d* are off-profile by an offset distance $O_{131,\ 132}$. Offset distance $O_{131,\ 132}$ is preferably less than 0.100", and more preferably between 0.020" and 0.100". In addition, the offset ratio of backup cutting faces 131-154*a-d*, 132-154*a-d* is preferably about 0.20.

Referring still to the rotated profile view of FIG. 11, each backup cutting face 131-54*a-d*, 132-154*a-d* tracks and is positioned at substantially the same radial position as an associated primary cutting face 131-144*c-f*, 132-144*c-f*, respectively on the same primary blade 131, 132, respectively. As a result of the relative sizes and radial positions of primary cutting faces 131-144*a-g*, 132-144*a-g* and backup cutting faces 131-154*a-d*, 132-154*a-d*, the cutting profile or path of each backup cutting face 131-154*a-d*, 131-154*a-d* is substantially eclipsed or overlapped by the cutting profile or path of its associated primary cutting face 131-144*c-f*, 131-144*c-f*, respectively.

In this embodiment, primary cutting faces 131-144*a-g* on primary blade 131 are staggered relative to primary cutting faces 132-144*a-g* on primary blade 132. However, primary cutting faces 131-144*a-g* and 132-144*a-g* at least partially overlap in rotated profile view, thereby offering the potential for increased bottomhole coverage for bit 100.

Although secondary blades 134, 135, 136, 137 and associated cutter elements 140, 150 are not shown in the rotated profile view of FIG. 11, the single backup cutter element 150 provided on each secondary blade 134, 135, 136, 137 has the same radial position as the primary cutter element 140 that it trails. The extension heights of cutting faces 144, 154 of cutter elements 140, 150, respectively, on one or more secondary blade 134, 135, 136, 137 may be the same or different.

Figure 12:
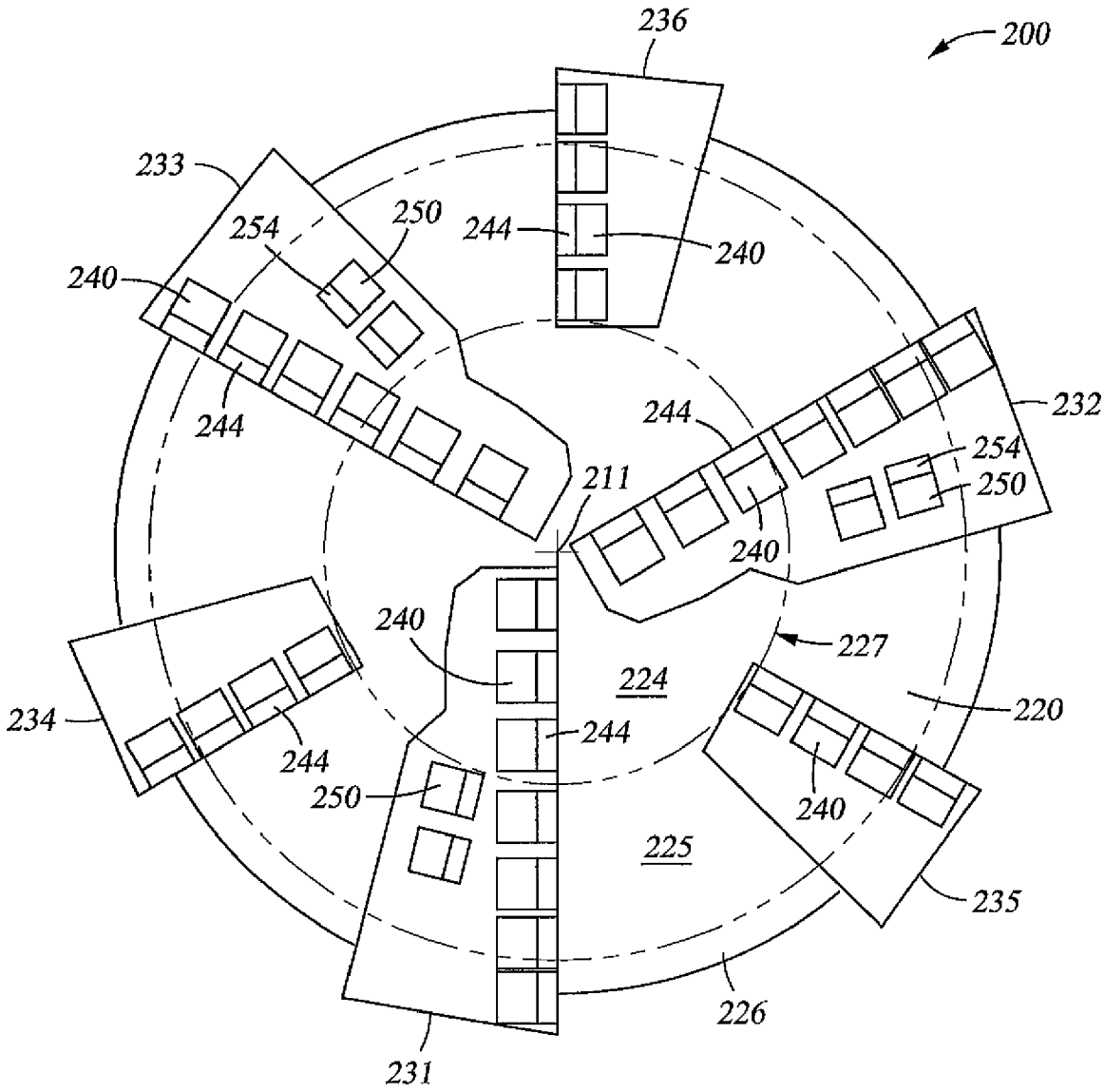
FIG. 12 is a schematic top view of an embodiment of a bit made in accordance with the principles described herein.
Figure 13:
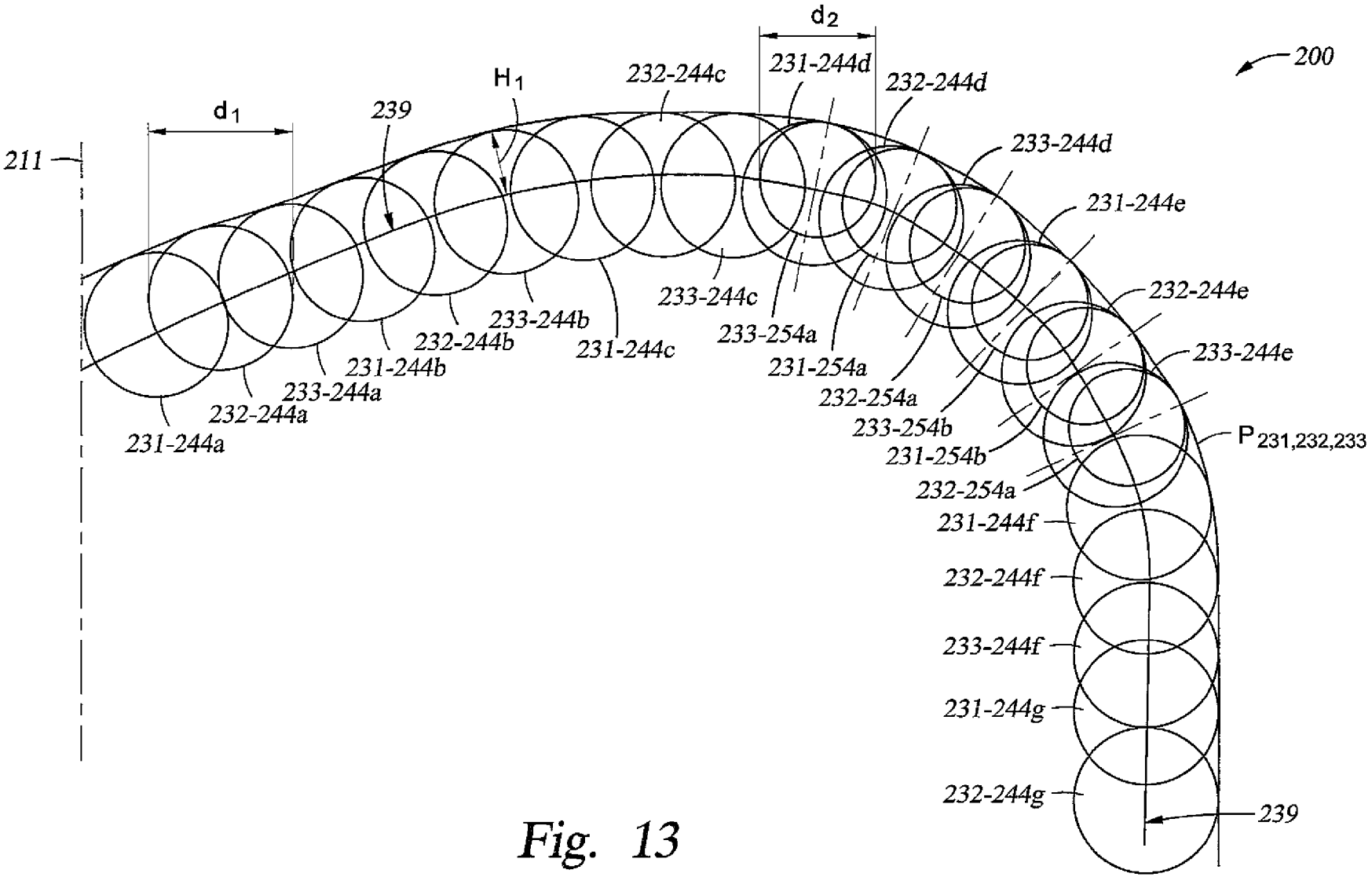
FIG. 13 is a schematic view showing the rotated profile of the primary blades shown in FIG. 12.

FIGS. 12 and 13 schematically illustrate another embodiment of a bit 200 constructed in accordance with the principles described herein. Specifically, FIG. 12 is a schematic top view of bit 200 and FIG. 13 is a schematic rotated profile view of the primary blades and cutter elements mounted thereon.

Referring now to FIG. 12, exemplary bit 200 has a central axis 211 and a bit face 220. Three angularly spaced-apart primary blades 231, 232, 233 and three angularly spaced apart secondary blades 234, 235, 236 extend radially along bit face 220. Bit face 220 may generally be divided into a cone region 224, a shoulder region 225, and a gage region 226. The nose or nose region 227 of bit face 220 is positioned at the transition between cone region 224 and shoulder region 225. In this embodiment, cone region 224 extends from central axis 211 to about 50% of the outer radius of bit 200 defining the full-gage diameter.

A plurality of primary cutter elements 240, each having a forward-facing primary cutting face 244, are mounted to the cutter-supporting surface 242 of each primary blade 231, 232, 233, and mounted to the cutter-supporting surface 252 of each secondary blade 234, 235, 236. In addition, one or more backup cutter elements 250, each having a forward-facing backup cutting face 154, are mounted to each primary blade 231, 232, 233, but not to any secondary blades 234, 235, 236. Thus, the backup cutter ratio is greater than 2.0. In general, the row of primary cutter elements 240 on each primary blade 231, 232, 233 extends radially from cone region 224 to gage region 226, while backup cutter elements 250 are positioned only in shoulder region 225.

Unlike bits 10 and 100 previously described, in this embodiment, backup cutter elements 250 are staggered relative to primary cutter elements 240 disposed on the same primary blade 231, 232, 233. Although each backup cutter element 250 has a different radial position relative to each primary cutter element 240 on the same primary blade 231, 232, 233, each backup cutter element 250 is disposed at the same radial position as another primary cutter element 240 on a different primary blade 231, 232, 233. More specifically, in this embodiment, each backup cutter element 250 on primary blade 231 is disposed at the same radial position as one of the primary cutter elements 240 on primary blade 232, each backup cutter element 250 on primary blade 232 is disposed at the same radial position as one of the primary cutter elements 240 on primary blade 233, and each backup cutter element 250 on primary blade 233 is disposed at the same radial position as one of the primary cutter elements 240 on primary blade 231. In other embodiments, the backup cutter elements on a particular primary blade may be redundant with the primary cutter elements on a secondary blade.

Referring still to FIG. 12, each primary cutter element 240 and each backup cutter element 250 is generally cylindrical. However, the diameter of each backup cutting face 254 is less than the diameter of each primary cutting face 244.

Referring now to FIG. 13, the profiles of primary blades 231, 232, 233 and associated cutting faces 244, 254, respectively, are shown rotated into a single rotated profile. For purposes of clarity and further explanation, primary cutting faces 244 of primary cutter elements 240 mounted to primary blades 231, 232, 233 are assigned reference numerals 231-244*a-g*, 232-244*a-g*, 233-244*a-f*, respectively, and backup cutting faces 254 of backup cutter elements 250 mounted to primary blades 231, 232, 233 are assigned reference numerals 231-254*a, b*, 232-254*a, b*, 233-254*a, b*, respectively. For purposes of clarity, secondary blades 234, 235, 236 and associated cutter elements 240 are not shown in FIG. 13.

Each primary cutting face 231-244*a-g*, 232-244*a-g*, 233-244*a-f* has substantially the same diameter $d_1$, and each backup cutting face 231-254*a, b*, 232-254*a, b*, 233-254*a, b* has the substantially the same diameter $d_2$ that is less than diameter $d_1$.

In rotated profile view, primary blades 231, 232, 233 have substantially the same blade profiles that form a composite blade profile 239 generally defined by cutter-supporting surfaces 242. Primary cutting faces 231-244*a-g*, 232-244*a-g*, 233-244*a-f* each extend to substantially the same extension height $H_1$ that defines the outermost cutting profile $P_{232, 232, 233}$ of primary blades 231, 232, 233. Likewise, backup cutting faces 231-254*a, b*, 232-254*a, b*, 233-254*a, b* each also have the same extension height $H_1$. Thus, in this embodiment, backup cutting faces 231-254*a, b*, 232-254*a, b*, 233-254*a, b* and primary cutting faces 231-244*a-g*, 232-244*a-g*, 233-244*a-f* extend to the same extension height $H_1$. Thus, backup cutting faces 231-254*a, b*, 232-254*a, b*, 233-254*a, b* are on-profile, and consequently, backup cutting faces 231-254*a, b*, 232-254*a, b*, 233-254*a, b* are not offset from outermost cutting profile $P_{232, 232, 233}$. Referring still to the rotated profile view of FIG. 13, each backup cutting face 231-254*a, b*, 232-254*a, b*, 233-254*a, b* tracks and is positioned at substantially the same radial position as an associated primary cutting face 232-244*d, e*, 233-244*d, e*, 231-244*d, e*, respectively, on a different primary blade 232, 233, 231, respectively. As a result of the relative sizes and radial positions of primary cutting faces 231-244*a-g*, 232-244*a-g*, 233-244*a-f* and backup cutting faces 231-254*a, b*, 232-254*a, b*, 233-254*a, b*, the cutting profile or path of each backup cutting face 231-254*a, b*, 232-254*a, b*, 233-254*a, b* is substantially eclipsed or overlapped by the cutting profile or path of its associated primary cutting face 232-244*d, e*, 233-244*d, e*, 231-244*d, e*, respectively.

Also shown in FIG. 13, primary cutting faces 244 on each primary blade 231, 232, 233 are staggered relative to the primary cutting faces 244 on each other primary blade 231, 232, 233. However, primary cutting faces 244 on different primary blades at least partially overlap in rotated profile view, thereby offering the potential for increased bottomhole coverage for bit 200.

Figure 14:
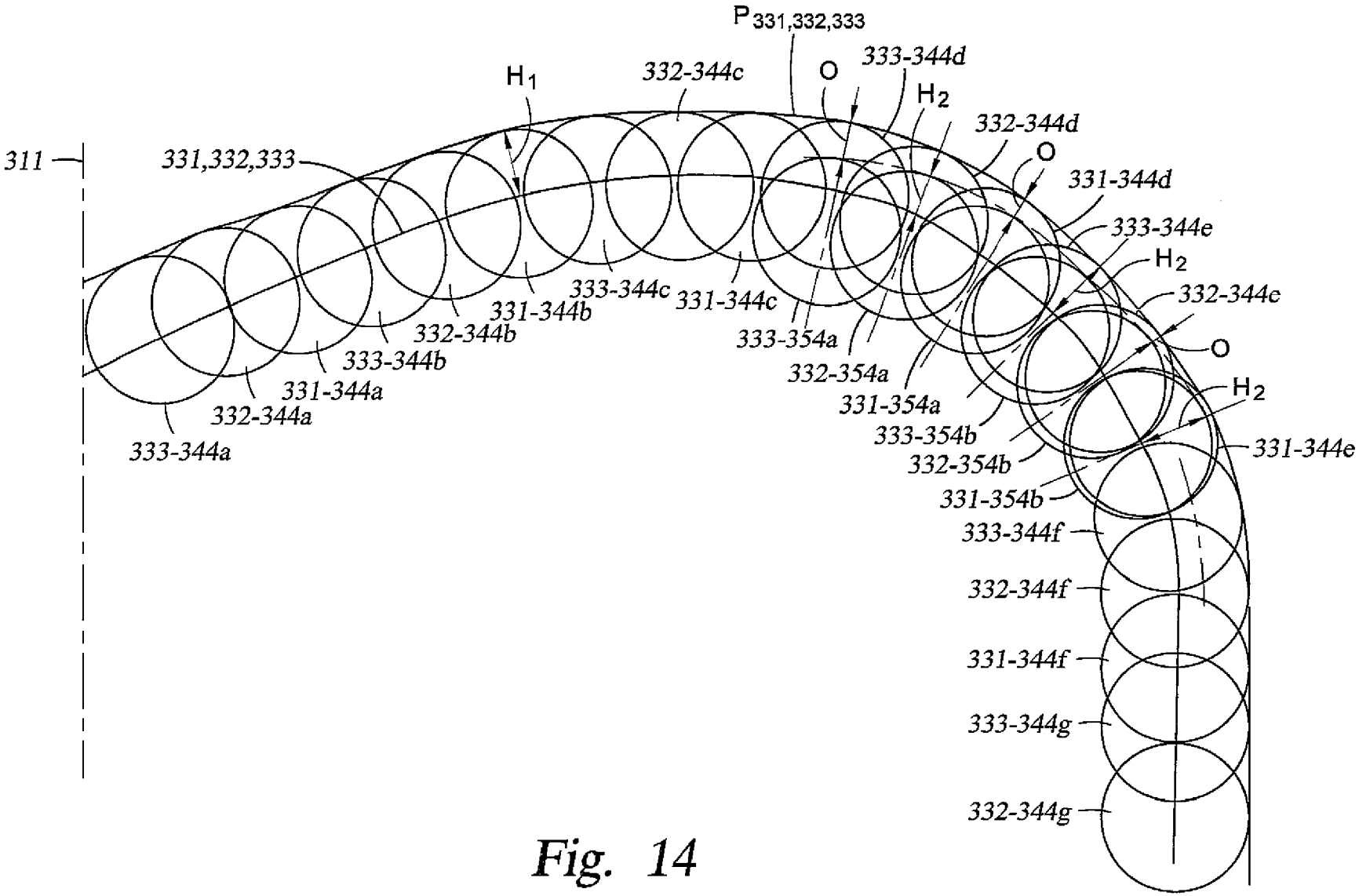
FIG. 14 is a schematic view showing the rotated profile of the primary blades of an embodiment of a bit made in accordance with the principles described herein.

FIG. 14 is a schematic rotated profile view of another embodiment of a bit 300 including three primary blades 331, 332, 333. Bit 300 is substantially the same as bit 10 previously described with the exception that the backup cutter elements on the primary blades have a non-uniform offset distance from the outermost cutting profile.

Referring now to FIG. 14, the profiles of primary blades 331, 332, 333 and associated primary cutting faces 344 and backup cutting faces 354 are shown rotated into a single rotated profile. For purposes of clarity and further explanation, primary cutting faces 344 mounted to primary blades 331, 332, 333 are assigned reference numerals 331-344*a-f*, 332-344*a-g*, 333-344*a-g*, respectively, and backup cutting faces 354 of backup cutter elements 350 mounted to primary blades 331, 332, 333 are assigned reference numerals 331-354*a, b*, 332-354*a, b*, 333-354*a, b*, respectively. The secondary blades and associated cutter elements of bit 300 are not shown in FIG. 14.

In rotated profile view, primary blades 331, 332, 333 define a composite blade profile 339. Primary cutting faces 331-344*a-f*, 233-344*a-g*, 333-344*a-g* each extend to substantially the same extension height $H_1$ that defines the outermost cutting profile $P_{331, 332, 333}$. Each backup cutting face 331-354*a, b*, 332-354*a, b*, 333-354*a, b* has an extension height $H_2$ that is less than extension height $H_1$. However, the extension height $H_2$ of each backup cutting face 331-354*a, b*, 332-354*a, b*, 333-354*a, b* is different. In particular, in rotated profile view, the extension height of backup cutting faces 331-354*a, b*, 332-354*a, b*, 333-354*a, b* generally increase moving radially from bit axis 311 towards gage. Consequently, the offset distance O of backup cutting faces 331-354*a, b*, 332-354*a, b*, 333-354*a, b* is non-uniform; offset distance O of backup cutting faces 331-354*a, b*, 332-354*a, b*, 333-354*a, b* decreases moving radially from bit axis 311 towards gage. Thus, in this embodiment, backup cutting faces 331-354*a, b*, 332-354*a, b*, 333-354*a, b* are offset from outermost cutting profile $P_{331, 332, 333}$ by a non-uniform offset distance O. In other embodiments, the extension height of the backup cutter elements may decrease moving radially toward gage, and thus, the offset distance O of such backup cutter elements may increase towards gage.

Figure 15:
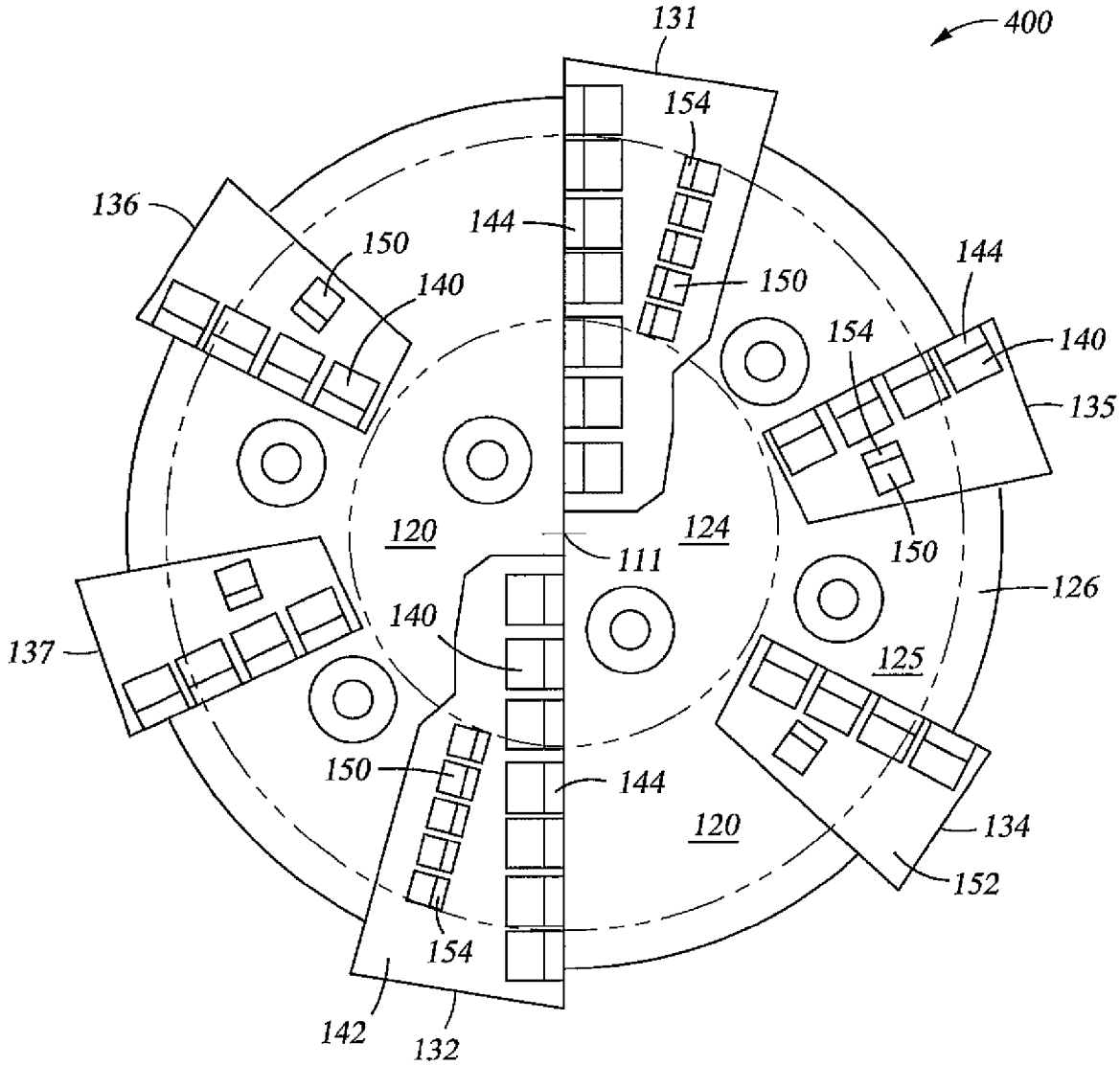
FIG. 15 is a schematic top view of an embodiment of a bit made in accordance with the principles described herein.

FIG. 15 is a schematic top view of another embodiment of a bit 400 that is substantially the same as bit 100 described. Similar to bit 100, bit 400 includes seven primary cutter elements 140 on each primary blade 131, 132, and four primary cutter elements 140 on each secondary blade 134, 135, 136, 137. In addition, one backup cutter element is provided on each secondary blade 134, 135, 136, 137. However, unlike bit 100, in this embodiment, five backup cutter elements 150 are provided on each primary blade 131, 132. As previously described, the backup cutter ratio of embodiments described herein is preferably greater than 1.0, and more preferably greater than 2.0. In this particular embodiment, the backup cutter ratio is 2.5 (a total of ten backup cutter elements 150 on primary blades 131, 132 and a total of four backup cutter elements 150 on secondary blades 134, 135, 136, 137).

While specific embodiments have been shown and described, modifications thereof can be made by one skilled in the art without departing from the scope or teaching herein. The embodiments described herein are exemplary only and are not limiting. For example, embodiments described herein may be applied to any bit layout including, without limitation, single set bit designs where each cutter element has unique radial position along the rotated cutting profile, plural set bit designs where each cutter element has a redundant cutter element in the same radial position provided on a different blade when viewed in rotated profile, forward spiral bit designs, reverse spiral bit designs, or combinations thereof. In addition, embodiments described herein may also be applied to straight blade configurations or helix blade configurations. Many other variations and modifications of the system and apparatus are possible. For instance, in the embodiments described herein, a variety of features including, without limitation, the number of blades (e.g., primary blades, secondary blades, etc.), the spacing between cutter elements, cutter element geometry and orientation (e.g., backrake, siderake, etc.), cutter element locations, cutter element extension heights, cutter element material properties, or combinations thereof may be varied among one or more primary cutter elements and/or one or more backup cutter elements. Accordingly, the scope of protection is not limited to the embodiments described herein, but is only limited by the claims that follow, the scope of which shall include all equivalents of the subject matter of the claims.

What is claimed is:

1. A drill bit for drilling a borehole in earthen formations, the bit comprising:

a bit body having a bit axis and a bit face including a cone region, a shoulder region, and a gage region;

a primary blade extending radially along the bit face from the cone region through the shoulder region to the gage region;

a plurality of primary cutter elements mounted to the primary blade;

at least one backup cutter element mounted to the primary blade in the shoulder region;

a secondary blade extending along the bit face from the shoulder region to the gage region;

a plurality of primary cutter elements mounted to the secondary blade;

wherein the secondary blade is free of backup cutter elements;

wherein each backup cutter element and each primary cutter element has a radial position;

wherein each backup cutter element mounted to the primary blade is disposed at substantially the same radial position as one of the plurality of primary cutter elements mounted to the primary blade;

wherein each primary cutter element includes a primary cutting face and wherein each backup cutter element includes a backup cutting face, wherein each primary cutting face and each backup cutting faces is forward-facing;

wherein the plurality of primary cutter elements mounted to the primary blade are arranged in a row extending radially from the cone region to the gage region, and the plurality of primary cutter elements mounted to the secondary blade are arranged in a row extending radially from the shoulder region to the gage region; and wherein the cone region is free of backup cutter elements.

2. The drill bit of claim 1, wherein each primary cutter element mounted to the secondary blade has a different radial position than each primary cutter element mounted to the primary blade.

3. The drill bit of claim 1, wherein each primary cutting face and each backup cutting face has an extension height, and wherein each primary cutting face on the primary blade has substantially the same extension height.

4. The drill bit of claim 3, wherein each backup cutting face on the primary blade has substantially the same extension height.

5. The drill bit of claim 4, wherein the extension height of each backup cutting face on the primary blade is less than the extension height of each primary cutting face on the primary blade.

6. The drill bit of claim 5, wherein the primary cutting faces on the primary blade define an outermost cutting profile in rotated profile view, wherein each backup cutting face on the primary blade is offset from the outermost cutting profile by an offset distance less than or equal to 0.100 inches.

7. The drill bit of claim 5, wherein the primary cutting faces on the primary blade define an outermost cutting profile in rotated profile view, and wherein each backup cutting face on the primary blade has an offset ratio between 0.020 and 0.200.

8. The drill bit of claim 5, wherein the extension height of each primary cutting face on the secondary blade is substantially the same.

9. The drill bit of claim 8, wherein the extension height of each primary cutting face on the secondary blade is substantially the same as the extension height of each primary cutting face on the primary blade.

10. The drill bit of claim 8, wherein the extension height of each primary cutting face on the secondary blade is less than the extension height of each primary cutting face on the primary blade.

11. The drill bit of claim 10, wherein the extension height of each primary cutting face on the secondary blade is less than the extension height of each backup cutting face on the primary blade.

12. The drill bit of claim 5 further comprising a depth-of-cut limiter mounted to the primary blade, wherein the depth-of-cut limiter has an extension height that is less than the extension height of each primary cutting face and less than the extension height of each backup cutting face.

13. The drill bit of claim 12 further comprising a depth-of-cut limiter mounted to the secondary blade having an extension height, wherein the extension height of each depth-of-cut limiter is substantially the same.

14. The drill bit of claim 4, wherein the extension height of each primary cutting face on the primary blade is substantially the same as the extension height of each backup cutting face on the primary blade.

15. The drill bit of claim 3, wherein the extension height of each backup cutting face on the primary blade is different.

16. The drill bit of claim 15, wherein the extension height of each backup cutting face increases toward the gage region in rotated profile view.

17. The drill bit of claim 1, wherein each primary cutting face and each backup cutting face has a diameter, wherein the diameter of each primary cutting face on the primary blade is substantially the same, and wherein the diameter of each backup cutting face on the primary blade is substantially the same.

18. The drill bit of claim 17, wherein the diameter of each primary cutting face on the primary blade is larger than the diameter of each backup cutting face on the primary blade.

19. The drill bit of claim 1, wherein the primary cutter elements and the backup cutter elements are mounted to the primary blade such that, in rotated profile, each backup cutting face on the primary blade is completely eclipsed by at least one of the primary cutting faces on the primary blade.

20. The drill bit of claim 19, wherein the primary cutter elements are mounted to the secondary blade such that, in rotated profile, each primary cutting face on the secondary blade is at least partially eclipsed by at least one of the primary cutting faces on the primary blade.

21. The drill bit of claim 1, wherein each backup cutter element on each primary blade has substantially the same radial position as one of the primary cutter elements on the same primary blade.

22. A drill bit for drilling a borehole in earthen formations, the bit comprising:

a bit body having a bit axis and a bit face comprising a cone region, a shoulder region, and a gage region;

a plurality of primary blades, each primary blade extending along the cone region, the shoulder region, and the gage region of the bit face;

a plurality of primary cutter elements mounted to each primary blade;

at least one backup cutter element mounted to each primary blade in the shoulder region;

a plurality of secondary blades, wherein each secondary blade begins at a location distal the bit axis and extends along the shoulder region and the gage region of the bit face;

a plurality of primary cutter elements mounted to each secondary blade;

at least one backup cutter element mounted to one of the plurality of secondary blades;

wherein the total number of backup cutter elements mounted to all of the primary blades is greater than the total number of backup cutter elements mounted to all of the blades that are not primary blades;

wherein each backup cutter element and each primary cutter element has a radial position; and wherein each backup cutter element on each primary blade has substantially the same radial position as one of the primary cutter elements on the same primary blade.

23. The drill bit of claim 22, wherein each primary cutter element includes a primary cutting face and each backup cutter element includes a backup cutting face, wherein each of the primary cutting faces and each of the backup cutting faces is forward-facing.

24. The drill bit of claim 23, wherein each primary cutter element mounted to the plurality of secondary blades has a different radial position than each primary cutter element mounted to the plurality of primary blades.

25. The drill bit of claim 23, wherein each primary cutting face and each backup cutting face has an extension height, and wherein each primary cutting face has substantially the same extension height.

26. The drill bit of claim 25, wherein the extension height of each backup cutting face is less than the extension height of each primary cutting face.

27. The drill bit of claim 26, wherein each backup cutting face has substantially the same extension height.

28. The drill bit of claim 26, wherein the extension height of each backup cutting face on the same primary blade is different.

29. The drill bit of claim 28, wherein the extension height of each backup cutting face on the same primary blade increases towards the gage region in rotated profile view.

30. The drill bit of claim 26, wherein the primary cutting faces on the plurality of secondary blades have substantially the same extension height.

31. The drill bit of claim 30, wherein the extension height of each primary cutting face on the plurality of secondary blades is substantially the same as the extension height of each primary cutting face on the plurality of primary blades.

32. The drill bit of claim 25, wherein the backup cutting faces and the primary cutting faces on the plurality of primary blades each have substantially the same extension height.

33. The drill bit of claim 25, wherein the primary cutting faces on the plurality of primary blades define an outermost cutting profile in rotated profile view, wherein each backup cutting face on the plurality of primary blades is offset from the outermost cutting profile by an offset distance less than 0.100 inches.

34. The drill bit of claim 33, wherein each backup cutting face on the primary blades has an offset ratio between 0.020 and 0.200.

35. The drill bit of claim 23, wherein each primary cutting face and each backup cutting face has an extension height, wherein the extension height of each primary cutting face on the plurality of secondary blades is less than the extension height of each primary cutting face on the plurality of primary blades.

36. A drill bit for drilling a borehole in earthen formations, the bit comprising:

a bit body having a bit axis and a bit face comprising a cone region, a shoulder region, and a gage region;

a first and a second primary blade, each primary blade extending along the cone region, the shoulder region, and the gage region of the bit face;

a plurality of primary cutter elements mounted to each primary blade;

a backup cutter element mounted to each primary blade in the shoulder region;

a plurality of secondary blades, wherein each secondary begins at a location distal the bit axis and extends along the shoulder region and the gage region of the bit face;

a plurality of primary cutter elements mounted to each secondary blade;

at least one backup cutter element mounted to one of the plurality of secondary blades;

wherein the total number of backup cutter elements mounted to all the primary blades is greater than the total number of backup cutter elements mounted to all of the blades that are not primary blades;

wherein each backup cutter element and each primary cutter element has a radial position;

wherein the backup cutter element on the first primary blade has a different radial position than each primary cutter element on the first primary blade; and wherein the backup cutter element on the first primary blade has the same radial position as one of the primary cutter elements on the second primary blade or one of the primary cutter elements on the secondary blade.

37. The drill bit of claim 36, wherein the ratio of the total number of backup cutter elements mounted to all the primary blades to the total number of backup cutter elements mounted to all the secondary blades is greater than or equal to 2.0.

38. The drill bit of claim 36, wherein each primary cutter element includes a primary cutting face and each backup cutter element includes a backup cutting face, wherein each of the primary cutting faces and each of the backup cutting faces is forward-facing.

39. The drill bit of claim 38, wherein the backup cutter element on the first primary blade has the same radial position as one of the primary cutter elements on the second primary blade.

40. The drill bit of claim 38, wherein each primary cutter element has a different radial position.

41. The drill bit of claim 38, wherein each primary cutting face and each backup cutting face has an extension height, and wherein each primary cutting face on the first and second primary blades has substantially the same extension height.

42. The drill bit of claim 41, wherein the extension height of each backup cutting face is less than the extension height of each primary cutting face on the first and second primary blades.

43. The drill bit of claim 42, wherein each backup cutting face has substantially the same extension height.

44. The drill bit of claim 43, wherein each primary cutting faces on the secondary blades has substantially the same extension height.

45. The drill bit of claim 44, wherein the extension height of each primary cutting face on the secondary blade is substantially the same as the extension height of each primary cutting face on the first primary blade.

46. The drill bit of claim 44, wherein the extension height of each primary cutting face on the secondary blade is less than the extension height of each primary cutting face on the first primary blade.

47. The drill bit of claim 42, wherein the extension height of each backup cutting face is different.

48. The drill bit of claim 47, wherein the extension height of each backup cutting face increases towards the gage region in rotated profile view.

49. The drill bit of claim 41, wherein the backup cutting faces and the primary cutting faces on the first and second primary blades have substantially the same extension height.

* * * * *